US009752543B2

(12) United States Patent
Ikeya

(10) Patent No.: US 9,752,543 B2
(45) Date of Patent: Sep. 5, 2017

(54) FUEL TANK

(71) Applicant: AISAN KOGYO KABUSHIKI KAISHA, Obu-shi, Aichi-ken (JP)

(72) Inventor: Masaki Ikeya, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 15/185,342

(22) Filed: Jun. 17, 2016

(65) Prior Publication Data

US 2016/0369756 A1 Dec. 22, 2016

(30) Foreign Application Priority Data

Jun. 18, 2015 (JP) ..... 2015-123136

(51) Int. Cl.

| | |
|---|---|
| ***F02M 37/04*** | (2006.01) |
| ***F02M 37/00*** | (2006.01) |
| *F02M 37/22* | (2006.01) |
| *F02M 37/02* | (2006.01) |
| *F02M 37/10* | (2006.01) |

(52) U.S. Cl.

CPC .... *F02M 37/0047* (2013.01); *F02M 37/0076* (2013.01); *F02M 37/103* (2013.01); *F02M 37/106* (2013.01); *F02M 37/025* (2013.01); *F02M 37/10* (2013.01); *F02M 37/22* (2013.01)

(58) Field of Classification Search

CPC .. F02M 37/103; F02M 37/106; F02M 37/025; F02M 37/22; F02M 37/10

USPC ..... 123/509

See application file for complete search history.

(56) References Cited

U.S. PATENT DOCUMENTS

| | | | | |
|---|---|---|---|---|
| 6,014,957 | A * | 1/2000 | Robinson | F02M 37/10 123/509 |
| 2008/0035120 | A1* | 2/2008 | Sone | F02M 37/103 123/509 |
| 2008/0184970 | A1* | 8/2008 | Igarashi | F02M 37/103 123/509 |

FOREIGN PATENT DOCUMENTS

| | | | | |
|---|---|---|---|---|
| FR | EP0947369 | * | 10/1999 | B60K 15/077 |
| FR | EP 0947369 | A1 * | 10/1999 | B60K 15/077 |
| JP | 64-11361 | U | 1/1989 | |
| JP | 2003-172217 | A | 6/2003 | |
| JP | 2008-174074 | A | 7/2008 | |
| JP | 2008-190429 | A | 8/2008 | |

* cited by examiner

*Primary Examiner* — Jacob Amick
*Assistant Examiner* — Charles Brauch
(74) *Attorney, Agent, or Firm* — Conley Rose, P.C.

(57) ABSTRACT

A fuel tank includes a tank main body having an opening, a pump unit mounted to a mounting position on a bottom of the tank main body through the opening and having a fuel pump and a pump retaining member retaining the fuel pump and, and a guide means configured to guide the pump unit from an opening side of the tank main body to the mounting position on a bottom side of the tank main body. The guide means includes a guide rail provided on the tank main body and a slider provided on the pump unit. The slider is configured to be slidably engaged with the guide rail.

13 Claims, 18 Drawing Sheets

FUEL TANK

CROSS-REFERENCE TO RELATED APPLICATIONS

This application claims priority to Japanese patent application serial number 2015-123136, filed Jun. 18, 2015, the contents of which are incorporated herein by reference.

STATEMENT REGARDING FEDERALLY SPONSORED RESEARCH OR DEVELOPMENT

Not applicable.

BACKGROUND

This disclosure relates to a fuel tank equipped with a tank main body storing fuel for an internal combustion engine, and a pump unit having a fuel pump force-feeding the fuel in the tank main body to the internal combustion engine.

Japanese Laid-Open Patent Publication No. 2003-172217 discloses a conventional fuel tank equipped with a tank main body, a bracket, and a pump unit. The bracket is provided at the bottom portion of the tank main body. The pump unit has a fuel pump and a pump retaining member holding the fuel pump. The pump unit is disposed on the bracket such that the axial direction of the pump unit is oriented horizontally. The tank main body has an opening in the upper surface portion thereof. The pump unit is mounted to the bracket after being inserted into the tank main body via the opening.

In a case of the conventional fuel tank disclosed in Japanese Laid-Open Patent Publication No. 2003-172217, the operation of mounting the pump unit to the bracket is performed manually by the operator. However, the opening area of the opening of the tank main body is relatively small. Further, the interior of the tank main body is rather dark and hard to see. Further, the distance from the opening of the tank main body to the bracket is rather large. Thus, when mounting the pump unit to the bracket by inserting it through the opening of the tank main body, the position of the bracket is rather hard to find. Thus, the mounting of the pump unit to the tank main body is rather hard to perform. Therefore, there has been a need for improved fuel tank.

BRIEF SUMMARY

In an aspect of this disclosure, a fuel tank includes a tank main body having an opening, a pump unit mounted to a mounting position on a bottom of the tank main body through the opening and having a fuel pump and a pump retaining member retaining the fuel pump, and a guide means configured to guide the pump unit from an opening side of the tank main body to the mounting position on a bottom side of the tank main body. The guide means includes a guide rail provided on the tank main body and a slider provided on the pump unit. The slider is configured to be slidably engaged with the guide rail. In this construction, when mounting the pump unit in the tank main body, the slider is slidably engaged with the guide rail of the guide means, whereby the pump unit is guided from the opening side of the tank main body to the mounting position on the bottom side. Thus, it is possible to properly move the pump unit to the mounting position easily without being at a loss. As a result, it is possible to shorten the operation time. Accordingly, it is possible to achieve an improvement in terms of the mounting property of the pump unit with respect to the tank main body.

In another aspect of this disclosure, a pair of the guide means are provided on both sides of the pump unit. In this construction, the pump unit is guided by both guide means, so that it is possible to achieve an improvement in terms of the mounting property of the pump unit with respect to the tank main body.

In another aspect of this disclosure, the tank main body has a sub tank disposed on the bottom of the tank main body and configured to store fuel to be sucked into the fuel pump. The guide rail extends to a position above an upper limit of the sub tank for storing the fuel in a horizontal attitude. In this construction, it is possible to guide the slider by the guide rail from the position higher than the upper limit of the sub tank for storing the fuel in the horizontal attitude.

In another aspect of this disclosure, the fuel tank further includes a rotation support means configured to rotatably support a longitudinal end portion of the pump unit inserted into the tank main body. The rotation support means includes a tank main body side support portion provided on the tank main body, and a pump unit side support portion provided on the pump unit. The pump unit side support portion is configured to be engaged with the tank main body side support portion. The guide rail has a first guide portion extending from the opening side toward the bottom side of the tank main body. In this construction, due to the first guide portion of the guide rail, it is possible to guide the slider of the pump unit from the opening side toward the bottom side of the tank main body. Further, through engagement between the tank main body side support portion and the pump unit side support portion of the rotation support means, it is possible to rotatably support the longitudinal end portion of the pump unit. Thus, it is possible to easily rotate the pump unit to the mounting position on the bottom portion side of the pump main body, using the rotation support means as a rotational fulcrum.

In another aspect of this disclosure, the guide rail has a second guide portion continuous with a bottom side end of the first guide portion and configured to guide the slider when the pump unit is rotated downwards using the rotation support means as a rotational fulcrum. In this construction, by rotating the pump unit using the rotation support means as the rotational fulcrum, the slider is guided by the second guide portion of the guide rail. Thus, it is possible to easily move the pump unit to the mounting position on the bottom portion side of the tank main body.

In another aspect of this disclosure, the second guide portion of the guide rail has a radius of curvature gradually diminished as the second guide portion extends downwards. The slider has an elastic member formed so as to be capable of elastic deformation when the slider slides downwards on the second guide portion. The second guide portion has a lock portion configured to be engaged with the slider through elastic restoration of the elastic member of the slider when the pump unit is rotated to the mounting position on the bottom of the tank main body. In this construction, when the slider slides on the second guide portion of the guide rail, the elastic member of the slider undergoes elastic deformation. And, when the pump unit is rotated to the mounting position on the bottom side of the tank body, the slider is engaged with the lock portion of the second guide portion through the elastic restoration of the elastic member of the slider, whereby the pump unit is locked to the tank main body. That is, the lock portion of the second guide portion and the slider form a lock means for locking the pump unit to the tank main body. Further, by utilizing the elasticity of the elastic member of the slider, the engagement of the slider with the lock portion of the second guide portion is released so as to detach the pump unit in an order reverse to that at the time of its insertion. Thus, it is possible to detachably mount the pump unit to the tank main body. Further, the lock means is formed by the lock portion of the second guide portion and the slider, so that there is no need to provide the lock means with any special member.

In another aspect of this disclosure, the fuel tank further includes a lock means including a tank main body side lock portion provided on the tank main body, and a pump unit side lock portion provided on the pump unit. The tank main body side lock portion and the pump unit side lock portion are configured to be engaged with each other by utilizing elastic deformation of at least one of the tank main body side lock portion and the pump unit side lock portion when the pump unit is rotated to the mounting position on the bottom of the tank main body using the rotation support means as the rotational fulcrum. In this construction, when the pump unit is rotated to the mounting position on the bottom portion side of the tank main body, the pump unit side lock portion is engaged with the tank main body side lock portion of the lock means by utilizing the elastic deformation of at least one of them, whereby the pump unit is locked to the tank main body. Further, by releasing the engagement of the pump unit side lock portion with the tank main body side lock portion by utilizing the elastic deformation of at least one of them, it is possible to detach the pump unit in an order reverse to that at the time of its insertion. Thus, it is possible to detachably mount the pump unit to the tank main body.

In another aspect of this disclosure, the slider includes a preceding side slider disposed at the longitudinal end portion of the pump unit. The guide rail has a third guide portion continuous with a bottom side end of the first guide portion and configured to guide the preceding side slider to a predetermined position along the bottom of the tank main body. In this construction, it is possible to guide the preceding side slider toward the rotation support means by the first guide portion and the third guide portion of the guide rail.

In another aspect of this disclosure, the preceding side slider serves as the pump unit side support portion. In this construction, there is no need to provide any special member as the pump unit side support portion of the rotation support means.

In another aspect of this disclosure, the guide means includes a guide member at the bottom side of the tank main body. The guide member is configured to guide the longitudinal end portion of the pump unit along the bottom of the tank main body. In this construction, it is possible to guide the longitudinal end portion of the pump unit toward the rotation support means by the guide member provided on the bottom side of the tank main body.

In another aspect of this disclosure, the longitudinal end portion of the pump unit has a stopper member. The tank main body has a contact member configured to contact the longitudinal end portion of the pump unit and an engagement member configured to be engaged with the stopper member. The contact member and the engagement member serve as the tank main body side support portion. The stopper member serves as the pump unit side support portion. In this construction, through engagement of the contact member and the engagement member of the rotation support means with the stopper member, it is possible to rotatably support the longitudinal end portion of the pump unit.

In the other aspect of this disclosure, the longitudinal end portion of the pump unit has a pump unit side lock portion. The tank main body has a tank main body side lock portion configured to be engaged with the pump unit side lock portion. The tank main body side lock portion serves as the tank main body side support portion. The pump unit side lock portion serves as the pump unit side support portion. In this construction, through engagement between the tank main body side lock portion of the rotation support means and the pump unit side lock portion, it is possible to rotatably support the longitudinal end portion of the pump unit.

DETAILED DESCRIPTION

In the following, embodiments relating to this disclosure will be described with reference to the drawings.

Figure 1:
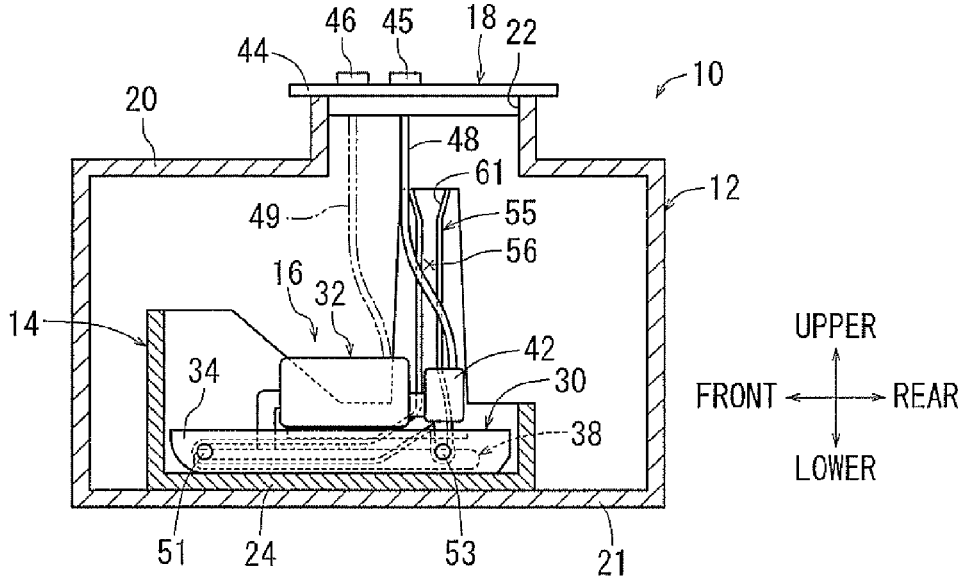
FIG. 1 is a sectional side view of a fuel tank having a pump unit, a sub tank and a tank main body according to a first embodiment.

A fuel tank 10 according to a first embodiment is configured to store fuel for an internal combustion engine of a vehicle, such as an automobile. As shown in FIG. 1, the fuel tank 10 is equipped with a tank main body 12, a sub tank 14, a pump unit 16, and a flange unit 18. In the drawings, the vertical direction corresponds to the gravitational direction or the so-called top-bottom direction of the fuel tank 10 as mounted in the vehicle. Further, for the sake of convenience, the front-rear direction and the right-left direction of the fuel tank 10 are determined as indicated by the arrows in the drawings. The arrows, however, do not specify the direction in which the fuel tank and the fuel pump are arranged.

The tank main body 12 will be described based on FIGS. 2 to 4. The tank main body 12 is formed as a hollow container having an upper surface portion 20 and a bottom surface portion 21. The upper surface portion 20 has a tank hole 22 formed as a round opening. The bottom surface portion 21 is formed to extend horizontally under a condition where the fuel tank 10 is mounted on the vehicle. The tank main body 12 may be formed of resin or metal. The tank hole 22 corresponds to the "opening" as referred to herein.

Figure 5:
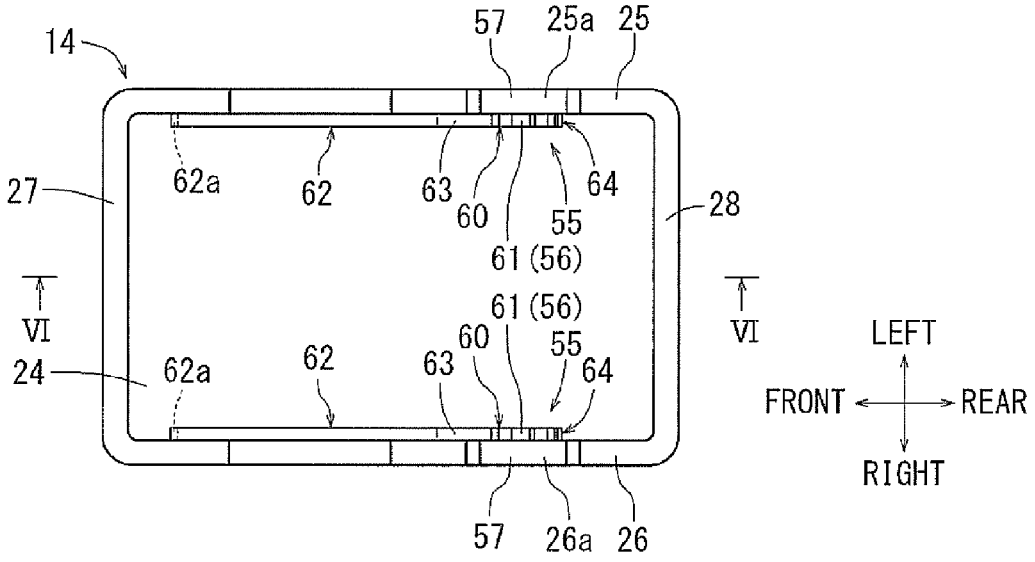
FIG. 5 is a plan view of the sub tank.
Figure 6:
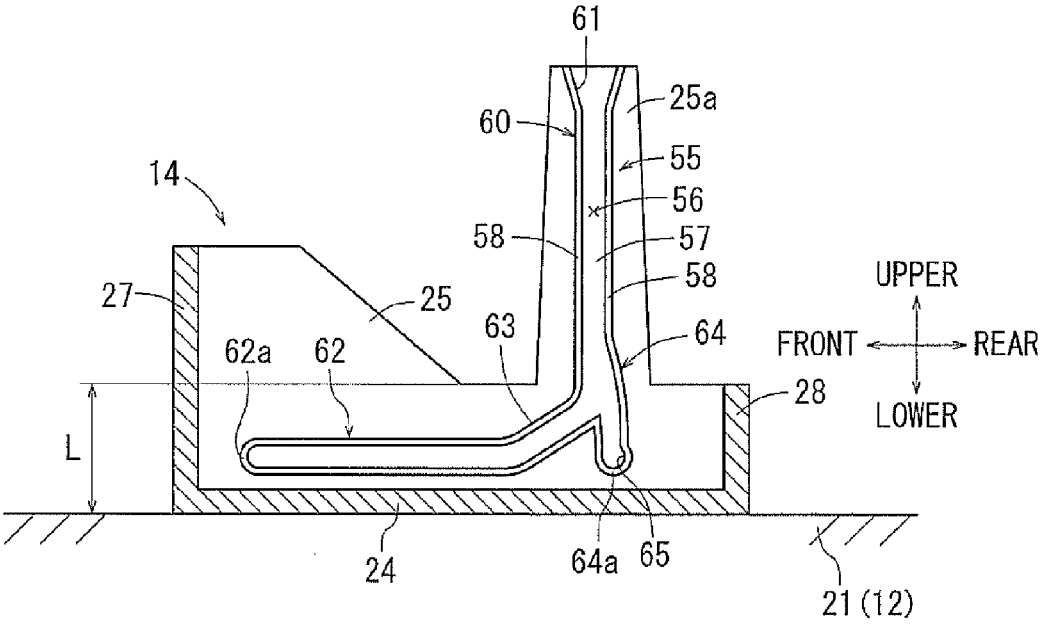
FIG. 6 is a cross-sectional view along line VI-VI in FIG. 5.

Next, the sub tank 14 will be described based on FIGS. 5 and 6. As shown in FIG. 5, the sub tank 14 is formed as a rectangular container elongated in the front-rear direction in plan view. The sub tank 14 has a bottom plate portion 24, a left-hand side plate portion 25, a right-hand side plate portion 26, a front side plate portion 27, and a rear side plate portion 28. The bottom plate portion 24 is formed as a flat plate extending in the horizontal direction. The sub tank 14 is open upwardly as shown in FIG. 6. As shown in FIG. 1, the sub tank 14 is fixedly installed at the bottom portion of the tank main body 12, that is, on the bottom surface portion 21. The bottom plate portion 24 is arranged so as to be in place contact with the bottom surface portion 21. The sub tank 14 is positioned just below the tank hole 22 or in the vicinity thereof. The sub tank 14 is configured to store fuel to be sucked into a fuel pump 32. The sub tank 14 may be formed of resin or metal.

As shown in FIG. 6, a front end portion of the sub tank 14 is set to be higher than the rest thereof. Thus, the fuel storage amount of the sub tank 14 under a condition where the tank main body 12 is inclined downwardly forwards is increased. Further, the upper end surfaces of the left-hand side plate portion 25, the right-hand side plate portion 26, and the rear side plate portion 28, excluding the front end portion of the sub tank 14, are of the same height. Thus, a height L of the left-hand side plate portion 25, the right-hand side plate portion 26, and the rear side plate portion 28 of the sub tank 14 correspond to a depth of the sub tank 14 capable of storing the fuel in the horizontal state. That is, a height position of the upper end surfaces of the left-hand side plate portion 25, the right-hand side plate portion 26, and the rear side plate portion 28 correspond to an upper limit of the sub tank 14 allowing storage of the fuel in the horizontal state.

Next, the pump unit 16 will be described. As shown in FIG. 4, the pump unit 16 includes a mount 30, the fuel pump 32, and other components. The mount 30 is formed, for example, of resin, and has a pair of right and left support side plates 34 and a base plate 36 as shown in FIG. 3. Both support side plates 34 are formed as strips extending in the front-rear direction, and are arranged in parallel to each other such that their thickness direction is oriented in the right-left direction. The base plate 36 is formed as a rectangular plate, and extends horizontally between central portions of upper end surfaces of both support side plates 34.

The mount 30 is placed in the sub tank 14 horizontally or substantially horizontally. The left-hand side support side plate 34 faces the left-hand side plate portion 25, and the right-hand side support side plate 34 faces the right-hand side plate portion 26. Front end portions of both support side plates 34 are in close proximity to or in contact with the front side plate portion 27. Rounded arcuate surfaces 34*a* are formed at the lower portions of the front ends of both support side plates 34. Inclined surfaces 34*b* are formed at the lower portions of the rear ends of both support side plates 34. The mount 30 corresponds to the "pump retaining member" as referred to herein.

The fuel pump 32 is an electric fuel pump for sucking in and discharging the fuel stored in the sub tank 14. The fuel pump 32 is formed in a substantially columnar configuration. The fuel pump 32 is arranged on the base plate 36 of the mount 30 horizontally such that an axis of the fuel pump 32 is oriented in the front-rear direction. The fuel pump 32 has a fuel suction port (not shown) at a front end thereof such that the fuel suction port is directed forwards. Further, the fuel pump 32 has a fuel discharge port (not shown) at a rear end thereof such that the fuel discharge port is directed rearwards. The horizontally arranged fuel pump 32 is substantially parallel to the tank hole 22 of the tank main body 12.

The fuel pump 32, more specifically, the fuel suction port thereof is connected with a fuel filter 38. The fuel filter 38 is equipped with a filter member 39 and a connection pipe 40 (see FIGS. 3 and 4). The filter member 39 is configured to filter the fuel sucked into the fuel pump 32, that is, the fuel stored in the sub tank 14. The filter member 39 is formed in a bag-like configuration of a non-woven cloth or the like of resin. The filter member 39 is shaped to have a rectangular outer configuration that is elongated in the front-rear direction in plan view and is flat in the vertical direction. In the interior space of the filter member 39, there is arranged an interior retaining member (not shown) made of resin for retaining the bag-like configuration of the filter member 39.

The connection pipe 40 is arranged on the front end portion of the filter member 39. The connection pipe 40 is formed of resin in an L-like or L-shaped configuration. One end of the connection pipe 40 is connected to the interior retaining member (not shown), and communicates with the interior space of the filter member 39. The other end of the connection pipe 40 is connected to the fuel pump 32, more specifically, the fuel suction port thereof. The connection pipe 40 communicates the internal space of the filter member 39 with the fuel suction port of the fuel pump 32. The filter member 39 is horizontally placed in a space surrounded by both support side plates 34 and the base plate 36 of the mount 30.

The fuel pump 32, more specifically, the fuel discharge port thereof is connected with a pressure regulator 42. The pressure regulator 42 is configured to adjust pressure of the fuel discharged from the fuel pump 32, to discharge the adjusted fuel from an outlet port (not shown), and to discharge surplus fuel into the tank main body 12 from a discharge port (not shown).

Figure 7:
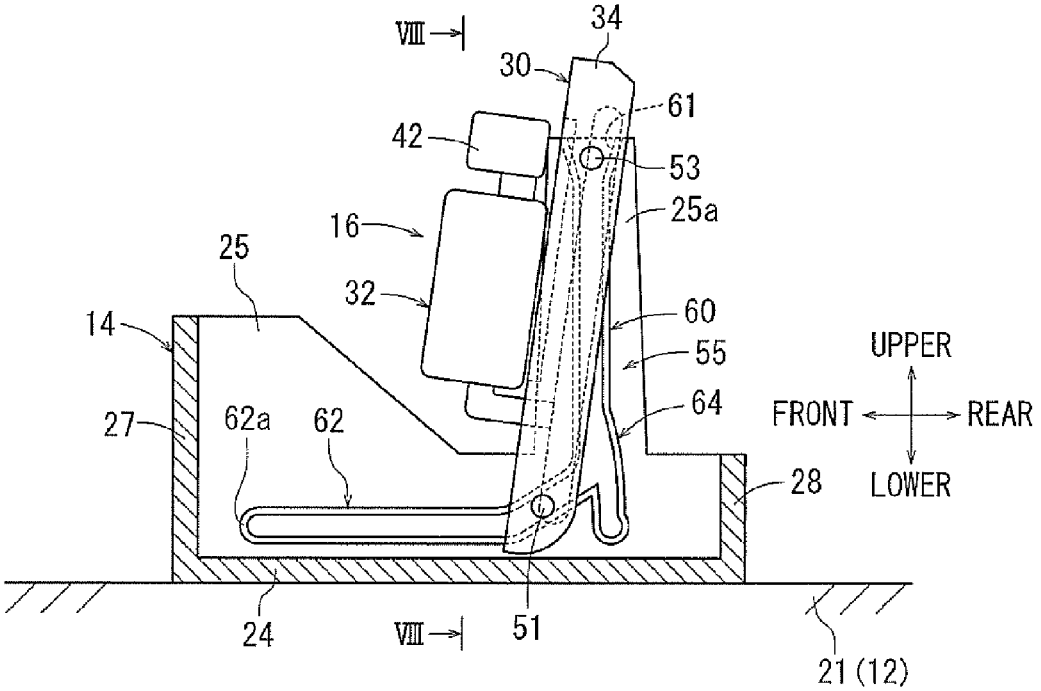
FIG. 7 is a sectional side view illustrating a first mounting process through which the pump unit is mounted to the tank main body.
Figure 8:
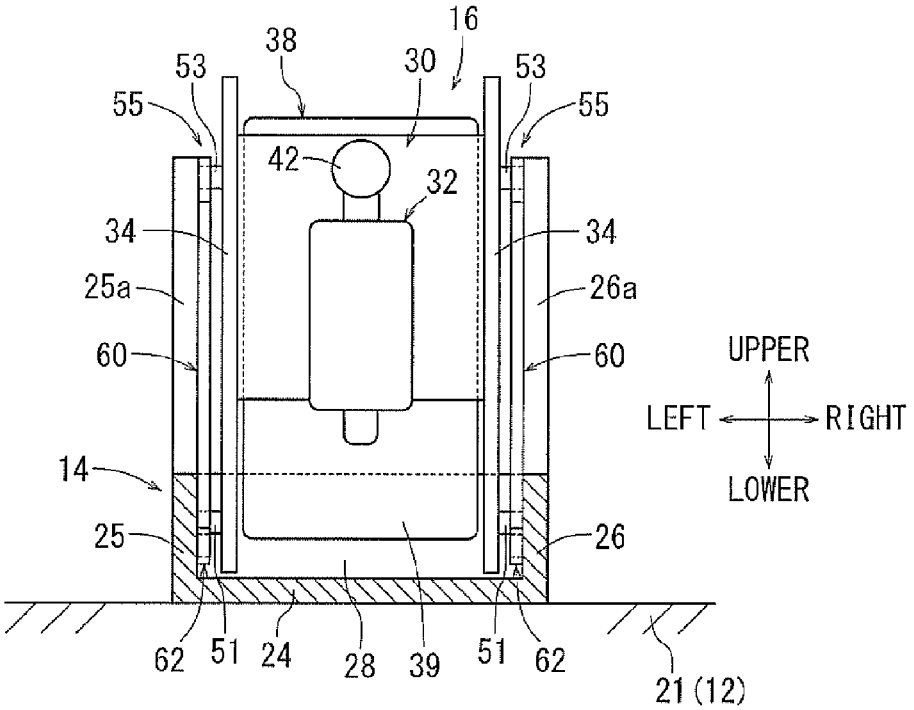
FIG. 8 is a cross-sectional view along line VIII-VIII in FIG. 7.

The pump unit 16 is mounted to the sub tank 14 such that the longitudinal direction of the pump unit 16 is oriented to the front-rear direction, whereby it is horizontally arranged at the bottom portion of the tank main body 12 as shown in FIG. 1. In this state, lower end surfaces of both support side plates 34 of the mount 30 are held in contact with the bottom plate portion 24 of the sub tank 14 as shown in FIG. 2. A predetermined gap is secured between the bottom plate portion 24 and the filter member 39 of the fuel filter 38 as shown in FIG. 4. An entire length of the pump unit 16 in the longitudinal direction, that is, an entire length of each support side plate 34, is set to be longer than the diameter of the tank hole 22 of the tank main body 12. The pump unit 16 is formed so as to be capable of passing through the tank hole 22 along the longitudinal direction of the pump unit 16. An attitude of the pump unit 16 passing through the tank hole 22 corresponds to an attitude in which the longitudinal direction of the pump unit 16 is oriented in the vertical direction or in the substantially vertical direction with respect to the tank hole 22 as shown in FIGS. 7 and 8, so that it will be referred to as vertical attitude or substantially vertical attitude. Further, the "substantially vertical attitude" as referred to herein also includes the inclined attitude in which the pump unit 16 is inclined with respect to the tank hole 22 by, for example, an inclination angle of 45 degrees or less. The mounting position of the pump unit 16 with respect to the sub tank 14 corresponds to the attitude in which the longitudinal direction of the pump unit 16 is oriented in the horizontal direction or in a substantially horizontal direction as shown in FIGS. 2 through 4. In the present embodiment, the longitudinal direction of the pump unit 16 is parallel to the axial direction of the fuel pump 32. Further, the axial direction of the fuel pump 32 may be inclined with respect to the longitudinal direction of the pump unit 16 in the vertical direction and/or the horizontal direction. The mounting structure of the pump unit 16 with respect to the sub tank 14 will be described below.

Next, the flange unit 18 will be described. As shown in FIG. 1, the flange unit 18 is attached to the tank hole 22 of the tank main body 12. The flange unit 18 is formed, for example, of resin, and is equipped with a disc-like flange main body 44 closing the tank hole 22. The flange main body 44 has a fuel discharge pipe 45, an electrical connector 46 and other components. The fuel discharge pipe 45 is connected to the pressure regulator 42, more specifically, the discharge port thereof via a piping member 48 consisting of a flexible bellows-like hose or the like at a lower surface side of the flange main body 44. The electrical connector 46 of the flange main body 44 is connected to the fuel pump 32, more specifically, an electrical connector thereof (not shown) via a flexible wiring member 49 at the lower surface side of the flange main body 44. Further, although not shown, at an upper surface side of the flange main body 44, the fuel discharge pipe 45 is connected with a fuel supply pipe connected to the internal combustion engine or the so-called engine. Further, the electrical connector 46 is connected with an external connector.

Next, operations of the pump unit 16 will be described. When the fuel pump 32 is driven by a drive electric power supplied from the exterior, the fuel pump 32 sucks the fuel from the sub tank 14 via the fuel filter 38. The fuel is increased in pressure by the fuel pump 32, is adjusted in fuel pressure by the pressure regulator 42, and then is discharged into the piping member 48. The fuel is supplied to the engine through the fuel discharge pipe 45 of the flange unit 18. The pump unit 16 and the flange unit 18 form a fuel supply device for supplying the fuel stored in the tank main body 12 to the engine.

Next, the mounting structure for the pump unit 16 with respect to the sub tank 14 will be described. As shown in FIGS. 2 and 3, at front end portions of both support side plates 34 of the mount 30, there are symmetrically provided round-shaft-like front side guide pins 51 each protruding outwardly sidewise. At rear end portions of both support side plates 34, there are symmetrically provided round-shaft-like rear side guide pins 53 each protruding outwardly sidewise. The front side guide pins 51 correspond to the "slider" and the "preceding side slider" as referred to herein. The rear side guide pins 53 correspond to the "slider" and the "succeeding side slider" as referred to herein. The configuration of the guide pins 51 and 53 is not restricted to the round-shaft-like one and may be formed as a rectangular-shaft-like configuration, a strip-like configuration, etc.

As shown in FIG. 5, on opposing side surfaces (i.e., inner side surfaces of the left-hand side plate portion 25 and the right-hand side plate portion 26 of the sub tank 14) there are symmetrically provided a pair of right and left guide rails 55. Each of the guide rails 55 is formed in a channel-like or channel-shaped sectional configuration having a guide groove 56. The guide grooves 56 are formed so as to allow slidable engagement with both guide pins 51 and 53 of the mount 30 as shown in FIG. 2.

As shown in FIGS. 5 and 6, each guide rail 55 has a groove bottom wall 57 and a pair of groove side walls 58 that extend parallel to each other. Both guide rails 55 utilize a part of the left-hand side plate portion 25 and a part of the right-hand side plate portion 26 as the groove bottom walls 57, respectively. Each of the guide rails 55 may have the groove bottom wall 57 separate from the left-hand side plate portion 25 and the right-hand side plate portion 26.

Each guide rail 55 has a first guide portion 60, a third guide portion 62, and a second guide portion 64. The first guide portions 60 extend from the tank hole 22 side of the tank main body 12 toward the bottom portion side. That is, the first guide portions 60 extend in the vertical direction or in a substantially vertical direction. The first guide portions 60 extend above the height position L which corresponds to the upper limit of the sub tank 14 for allowing storage of the fuel in the horizontal state (i.e., when the bottom plate portion 24 of the sub tank 14 extends horizontally). Upwardly protruding protrusions 25*a* and 26*a* are formed on the left-hand side plate portion 25 and the right-hand side plate portion 26 of the sub tank 14 as shown in FIGS. 5 and 6. Further, each first guide portion 60 has an introduction port 61 upwardly open at an upper end portion of the guide groove 56. The pair of groove side walls 58 at each introduction port 61 are formed to upwardly and gradually increase a distance therebetween. Because each of the introduction ports 61 is located in the vicinity of the tank hole 22 of the tank main body 12 as shown in FIG. 1, visual recognition of the introduction ports 61 through the tank hole 22 can be easily performed by the operator.

Because the right and left guide rails 55 have symmetric configurations, a detailed configuration of the left guide rail 55 will be described mainly, whereas that of the right guide rail 55 will not be described for convenience of explanation. As shown in FIG. 6, the third guide portion 62 is continuous with a bottom side end portion, that is, a lower end portion of the first guide portion 60, and extends forwards. A rear end portion of the third guide portion 62 is formed as an inclined portion 63 inclined forwards and obliquely downwards. A front end surface of the guide groove 56 of the third guide portion 62 is closed by a front end wall 62*a*. Further, when the front side guide pin 51 of the mount 30 contacts the front end wall 62*a* of the third guide portion 62 during mounting of the pump unit 16 to the sub tank 14, the rear side guide pin 53 is situated in the vicinity of the lower end portion of the first guide portion 60, that is, in the vicinity of a connection portion of the second guide portion 64 as shown in FIG. 9.

The second guide portion 64 is continuous with the lower end portion of the first guide portion 60, and extends downwards in an arcuate fashion. A lower end portion of the guide groove 56 of the second guide portion 64 is closed by a lower end wall 64*a*. The second guide portion 64 is formed to have a radius of curvature substantially in conformity with the rotational path of the rear side guide pin 53 accompanying the vertical rotation of the mount 30 around the front side guide pin 51 held in contact with the front end wall 62*a* of the third guide portion 62.

In the present embodiment, the radius of curvature of the second guide portion 64 is set so as to be gradually diminished downwards as shown in FIG. 6. At the lower end portion of the rear side groove side wall 58 of the second guide portion 64, there is formed a lock groove portion 65 recessed rearwards in an arcuate fashion. Further, the mount 30 is formed so as to be capable of elastic deformation or so-called flexural deformation in which the central portion thereof in the front-rear direction is upwardly curved. The mount 30 may be formed such that the central portion is downwardly curved due to the elastic deformation.

Figure 2:
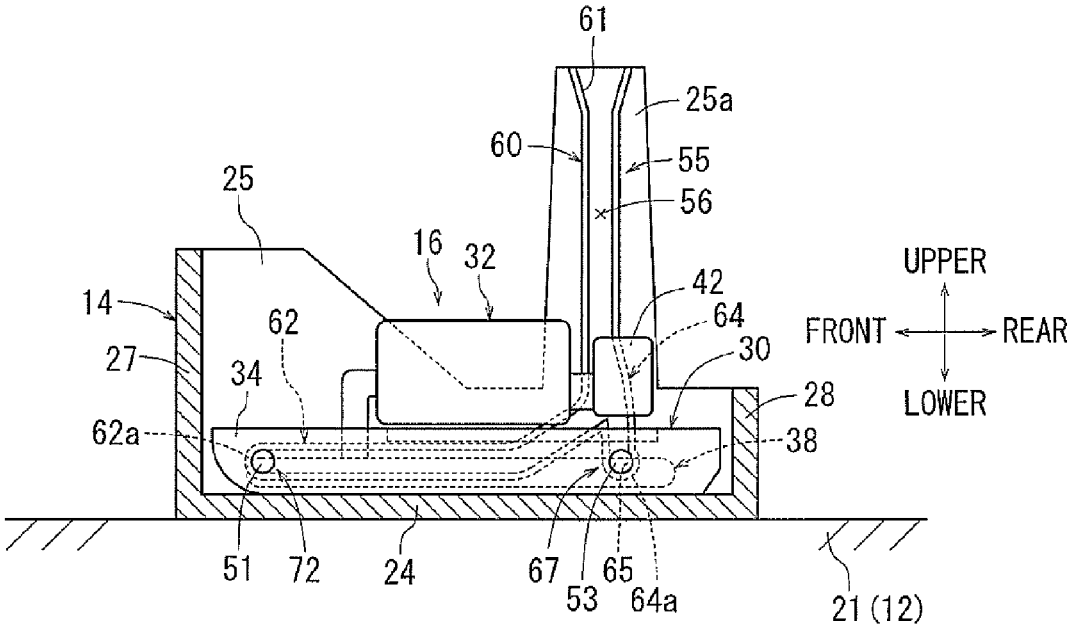
FIG. 2 is a partial cross-sectional view of the pump unit mounted to the sub tank.
Figure 9:
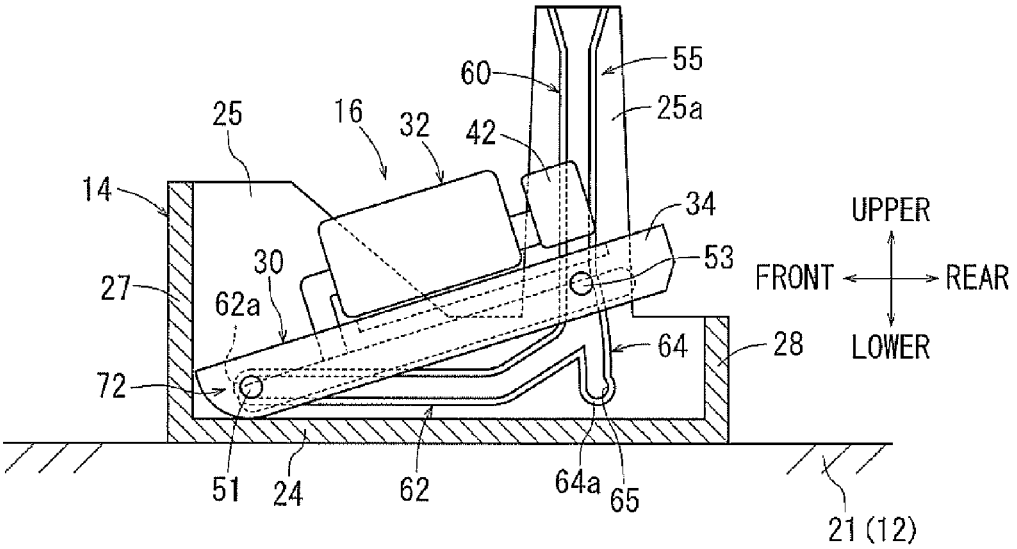
FIG. 9 is a sectional side view illustrating a second mounting process through which the pump unit is mounted to the tank main body.

Thus, when the pump unit 16 is rotated from the inclined attitude shown in FIG. 9 toward the mounting position shown in FIG. 2, the rear side guide pin 53 is forwardly moved while sliding along the second guide portion 64. As a result, the mount 30 undergoes elastic deformation in an upwardly warped state. And, when the pump unit 16 reaches the mounting position with respect to the sub tank 14 as shown in FIG. 2, the rear side guide pin 53 contacts the lower end wall 64*a* of the second guide portion 64, and the rear side guide pin 53 is engaged with or undergoes so-called snap-fit engagement with the lock groove portion 65 due to the elastic restoring force of the mount 30. As a result, the pump unit 16 is locked to the tank main body 12. That is, the lock groove portion 65 of the second guide portion 64 and the rear side guide pin 53 form a lock means 67 (see FIG. 2). The mounting position with respect to the sub tank 14 corresponds to the "mounting position on the bottom side of the tank main body" as referred to herein.

The mount 30 corresponds to the "slider side member" as referred to herein. The lock groove portion 65 corresponds to the "lock portion," and the "tank main body side lock portion" as referred to herein. Further, a guide means is formed by the two guide pins 51 and 53 and the guide rail 55. A pair of the guide means are symmetrically arranged on both the right and left sides of the pump unit 16 as shown in FIG. 3. Further, the front end wall 62*a* corresponding to the front end portion of the third guide portion 62 as the "tank main body side support portion" and the front side guide pin 51 as the "pump unit side support portion" rotatably and detachably engage with each other, whereby the front end wall 62*a* and the front side guide pin 51 form a rotation support means 72 as shown in FIG. 2.

Next, a method of mounting the pump unit 16 to the tank main body 12 will be described. The mounting of the pump unit 16 is performed through manual operation by the operator. The pump unit 16 is inserted into the tank main body 12 through the tank hole 22. At this time, the pump unit 16 is in the vertical attitude or in the substantially vertical attitude where the front end portion of the pump unit 16 is directed downwards. The vertical attitude or the substantially vertical attitude includes the inclined attitude in which the front end portion of the pump unit 16 is inclined downwards and obliquely forwards (see FIG. 7).

The front side guide pins 51 of the pump unit 16 are engaged with the first guide portions 60 via the introduction ports 61 of the guide rails 55 of the sub tank 14, and are caused to slide downwards along the first guide portions 60. Subsequently, the front side guide pins 51 are caused to slide on the third guide portions 62 from the lower end portions of the first guide portions 60. Further, the rear side guide pins 53 are caused to be engaged with the first guide portions 60 via the introduction ports 61 of the guide rails 55. This state corresponds to a first mounting process shown in FIGS. 7 and 8.

From this state, while moving the front side guide pins 51 forwards along the third guide portions 62, the rear side guide pins 53 are caused to slide downwards along the first guide portions 60. Then, the front side guide pins 51 are brought into contact or engaged with the front end walls 62*a* of the third guide portions 62. As a result, the pump unit 16 assumes an inclined attitude in which the rear end portion thereof is inclined obliquely upwards. This state corresponds to a second mounting process shown in FIG. 9.

Subsequently, the pump unit 16 is caused to rotate downwards using as the rotational fulcrum the rotation support means 72 formed by the engagement between the front end walls 62*a* of the third guide portions 62 and the front guide pins 51 as shown in FIG. 9. That is, the rear end portion of the pump unit 16 is pressed down. Then, the rear side guide pins 53 are moved forwards while sliding along the second guide portions 64, whereby the mount 30 undergoes elastic deformation. And, when the pump unit 16 reaches the mounting position where it is mounted to the sub tank 14 as shown in FIG. 2, the rear side guide pins 53 contact the lower end walls 64*a* of the second guide portions 64, and the rear side guide pins 53 are engaged with the lock groove portions 65 through the elastic restoring force of the mount 30. As a result, the pump unit 16 is locked to the tank main body 12. In this state, the lower end surfaces of both support side plates 34 of the mount 30 contact the bottom plate portion 24 of the sub tank 14. After this, the flange unit 18 is attached to the tank hole 22 of the tank main body 12, whereby the operation of mounting the pump unit 16 is completed.

There are cases where it is desirable to remove the pump unit 16 (e.g., for performing replacement of the pump unit 16 because of clogging of the fuel filter 38, failure of the fuel pump 32 or the like). In such cases, the flange unit 18 is removed from the tank hole 22 of the tank main body 12, and then the pump unit 16 is caused to rotate upwards using the rotation support means 72 as the rotational fulcrum. That is, the rear end portion of the pump unit 16 is raised. As a result, the engagement of the rear side guide pins 53 with the lock groove portions 65 of the guide rails 55 is released. Then, the pump unit 16 is removed in an order reverse to that at the time of its insertion.

According to the fuel tank 10 described above, when mounting the pump unit 16 in the tank main body 12, both guide pins 51 and 53 are guided by the guide rails 55 of the guide means. As a result, the pump unit 16 is guided from the tank hole 22 side of the tank main body 12 to the mounting position on the bottom portion side. Thus, it is possible to properly move the pump unit 16 to the mounting position easily without being at a loss. Thus, it is possible to shorten the operation time, and to suppress defective mounting of the pump unit 16. Thus, it is possible to achieve an improvement in terms of the mounting property and mounting operations of the pump unit 16 with respect to the tank main body 12.

Figure 3:
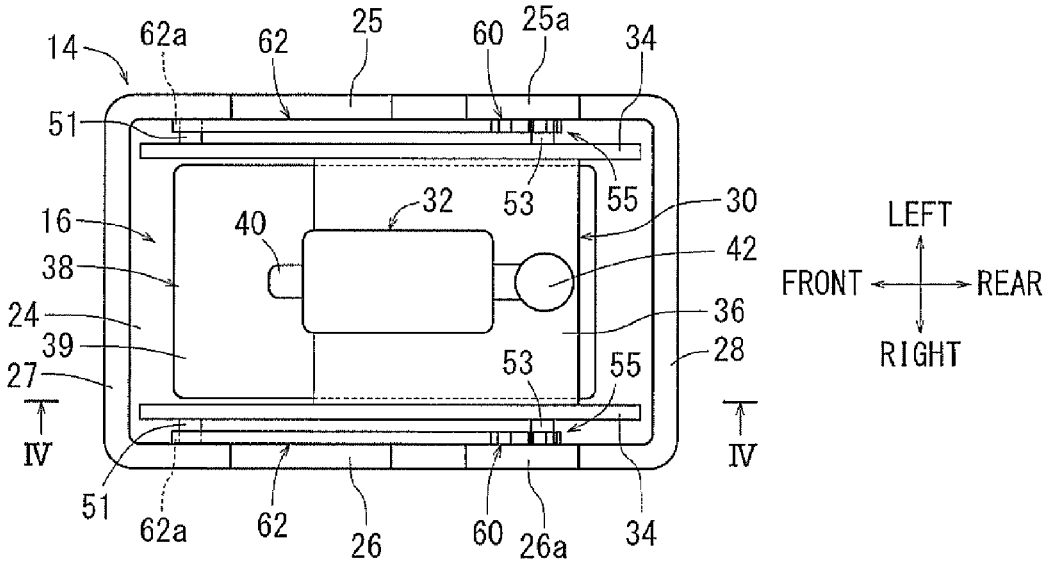
FIG. 3 is a plan view of the pump unit mounted to the sub tank.
Figure 4:
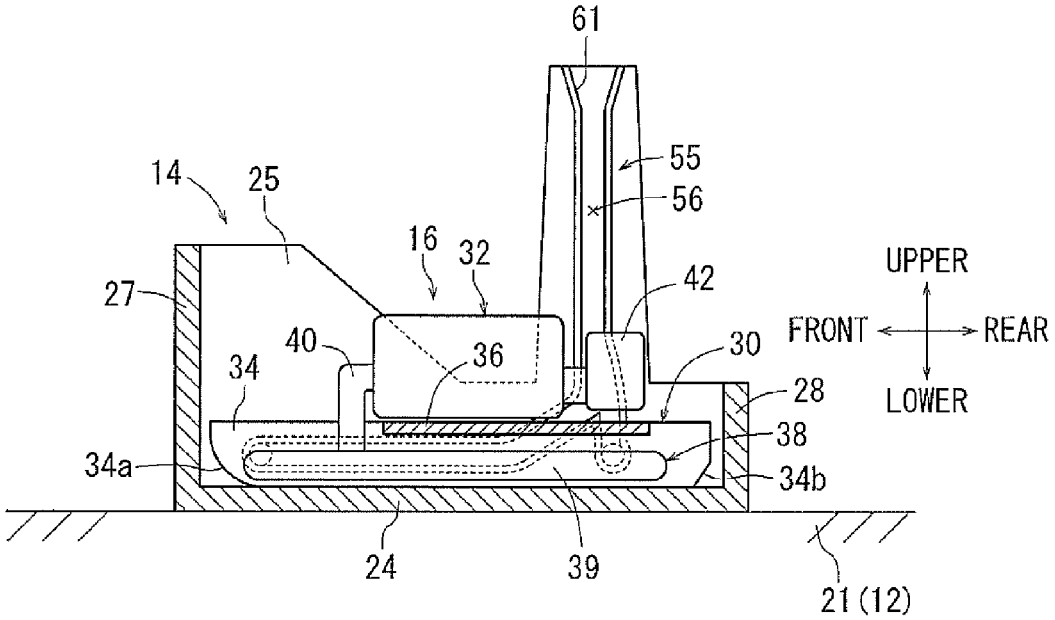
FIG. 4 is a cross-sectional view along line IV-IV in FIG. 3.

Further, the guide means are arranged on both sides of the pump unit 16 as shown in FIGS. 3 and 8. Thus, the pump unit 16 is guided by both guide means, so that it is possible to achieve an improvement in terms of the mounting property and mounting operations of the pump unit 16 with respect to the tank main body 12.

Further, the guide rails 55 extend above the height position L allowing storage of fuel in the horizontal state of the sub tank 14 that is provided at the bottom portion of the tank main body 12 as shown in FIG. 6. Thus, it is possible to guide both guide pins 51 and 53 by the guide rails 55 from a position higher than the height position L. Further, the operator can easily engage both guide pins 51 and 53 of the pump unit 16 with the introduction ports 61 while visually checking the introduction ports 61 of the guide rails 55 in the vicinity of the tank hole 22 of the tank main body 12. Thus, it is possible to achieve an improvement in terms of the reliability of the mounting of the pump unit 16. Further, it is possible to prevent contact of the pump unit 16 with respect to the tank main body 12 when passing the pump unit 16 through the tank hole 22. Thus, it is possible to suppress damage of the pump unit 16 due to the contact between the tank main body 12 and the pump unit 16, and generation of and falling into the tank main body 12 of foreign matter, such as a burr or a chip.

Further, each rotation support means 72 rotatably supporting one longitudinal end portion of the pump unit 16 is formed by the front end wall 62*a* (i.e., the tank main body side support portion) of the third guide portion 62 provided on the tank main body 12, and the front side guide pin 51 (i.e., the pump unit side support portion) provided on the pump unit 16 and engaged with the front end wall 62*a* of the third guide portion 62. Further, each guide rail 55 is provided with the first guide portion 60 extending from the tank hole 22 side to the bottom portion side of the tank main body 12. Thus, due to the first guide portions 60 of the guide rails 55, it is possible to guide the front side guide pins 51 of the pump unit 16 from the tank hole 22 side to the bottom portion side of the tank main body 12. When bringing the pump unit 16 from the inclined attitude shown in FIG. 9 to the mounting position with respect to the sub tank 14, which is shown in FIG. 2, it is possible to rotatably support one longitudinal end portion (i.e., the front end portion) of the pump unit 16 through engagement between the front end walls 62*a* (i.e., the tank main body side support portions) of the third guide portions 62 of the rotation support means 72 and the front side guide pins 51 (i.e., the pump unit side support portions as shown in FIGS. 2 and 9). Thus, by using the rotation support means 72 as the rotational fulcrum, it is possible to easily rotate the pump unit 16 to the mounting position on the bottom portion side of the tank main body 12.

Further, there are provided the second guide portions 64 continuous with the bottom portion side end portions of the first guide portions 60 and configured to guide the rear side guide pins 53 when downwardly rotating the pump unit 16 using the rotation support means 72 as the rotational fulcrum. Thus, by rotating the pump unit 16 using the rotation support means 72 as the rotational fulcrum, the rear side guide pins 53 are guided by the second guide portions 64 of the guide rails 55. Thus, it is possible to easily move the pump unit 16 to the mounting position on the bottom portion side of the tank main body 12.

When the rear side guide pins 53 slide downwards on the second guide portions 64 of the guide rails 55, the mount 30 undergoes elastic deformation. And, when the pump unit 16 is brought to the mounting position with respect to the sub tank 14 as shown in FIG. 2, the rear side guide pins 53 are engaged with the lock groove portions 65 of the second guide portions 64 due to the elastic restoration of the mount 30, whereby the pump unit 16 is locked to the tank main body 12. Further, by releasing the engagement of the rear side guide pins 53 with the lock groove portions 65 of the second guide portions 64 by utilizing the elasticity of the mount 30, it is possible to remove the pump unit 16 in an order reverse to that at the time of its insertion. Thus, it is possible to detachably mount the pump unit 16 to the tank main body 12. Further, the lock means 67 are formed by the lock groove portions 65 of the second guide portions 64 and the rear side guide pins 53 as shown in FIG. 2, so that there is no need to provide any special member, such as a spring, as the lock means 67.

Further, the front side guide pins 51 are provided at one longitudinal end portion of the pump unit 16, and the guide rails 55 are provided with the third guide portions 62 continuous with the bottom portion side end portions of the first guide portions 60 and configured to guide the front side guide pins 51 to predetermined positions along the bottom portion of the tank main body 12. Thus, it is possible to guide the front side guide pins 51 toward the rotation support means 72 by the first guide portions 60 and the third guide portions 62 of the guide rails 55.

Further, each front side guide pin 51 is configured so as to serve also as the pump unit side support portion of the rotation support means 72 shown in FIG. 2. Thus, there is no need to provide any special member as the pump unit side support portion. Further, by using the front end walls 62*a* of the third guide portions 62 as the tank main body side support portions of the rotation support means 72, there is no need to provide any special member as the tank main body side support portion.

Although the mount 30 is formed to be capable of elastic deformation in the present embodiment, the front side guide pins 51 and/or the rear side guide pins 53 may be formed to be capable of elastic deformation as the slider side member. Further, instead of forming the slider side member capable of elastic deformation, it is also possible to configure the front side guide pins 51 and/or the rear side guide pins 53 to slide along the mount 30 toward each other, and to provide at least one spring member biasing the front side guide pins 51 and/or the rear side guide pins 53 in order to increase a distance therebetween.

Figure 10:
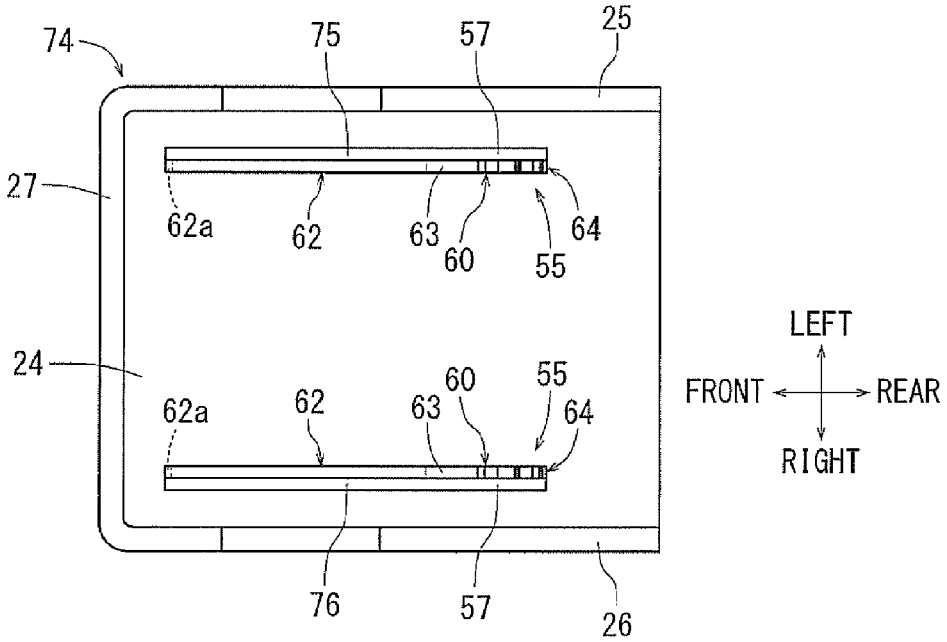
FIG. 10 is a plan view of the sub tank according to a second embodiment.

Embodiments described hereinafter correspond to the first embodiment each having some changes, so the changes will be described, and the same configurations will not be described. A second embodiment will be described based on FIG. 10. As shown in FIG. 10, the sub tank 74 of the second embodiment does not have a rear side plate portion corresponding to the rear side plate portion 28 of the sub tank 14 of the first embodiment. The sub tank 74 is formed to have a width dimension in the right-left direction larger than that of the sub tank 14 of the first embodiment. The right and left guide rails 55 are formed separately from the left-hand side plate portion 25 and the right-hand side plate portion 26, respectively. Further, a left side plate 75 and a right side plate 76 are provided to extend upward from the bottom plate portion 24. The distance between the left side plate 75 and the right side plate 76 is set to the same as the distance between the left-hand side plate portion 25 and the right-hand side plate portion 26 of the sub tank 14 of the first embodiment. The guide rails 55 are provided symmetrically on opposing side surfaces of the left side plate 75 and the right side plate 76. A part of the left side plate 75 and a part of the right side plate 76 serve as the groove bottom walls 57 of the guide rails 55. Further, the left-hand side plate portion 25 and the right-hand side plate portion 26 have no protrusion corresponding to the protrusions 25*a* and 26*a* of the first embodiment.

The sub tank 74 of the present embodiment allows common use of the pump unit 16 of the first embodiment. The left side plate 75 and the right side plate 76 equipped with the guide rails 55 may be arranged on the bottom surface portion 21 of the tank main body 12. Further, the left side plate 75 and the right side plate 76 may be provided with the guide rails 55 having the groove bottom walls 57 that are separate from the left side plate 75 and the right side plate 76.

Figure 11:
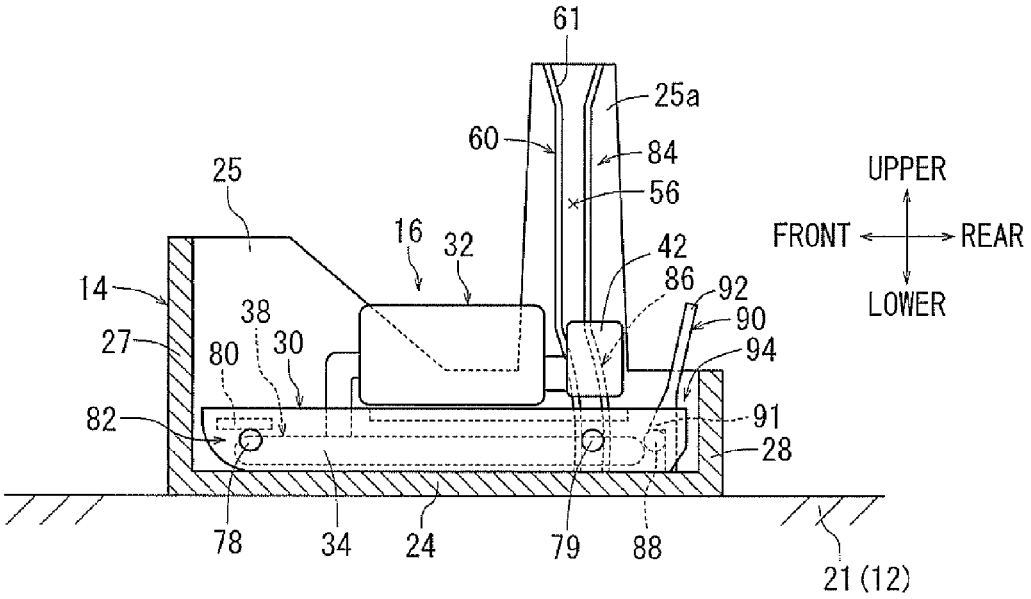
FIG. 11 is a sectional side view of the pump unit mounted to the sub tank according to a third embodiment.
Figure 12:
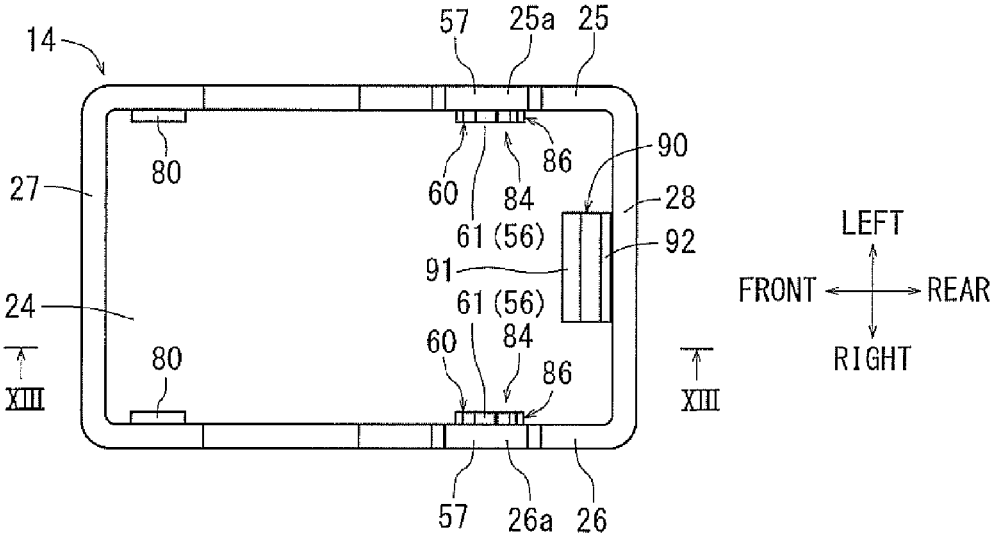
FIG. 12 is a plan view of the sub tank.
Figure 13:
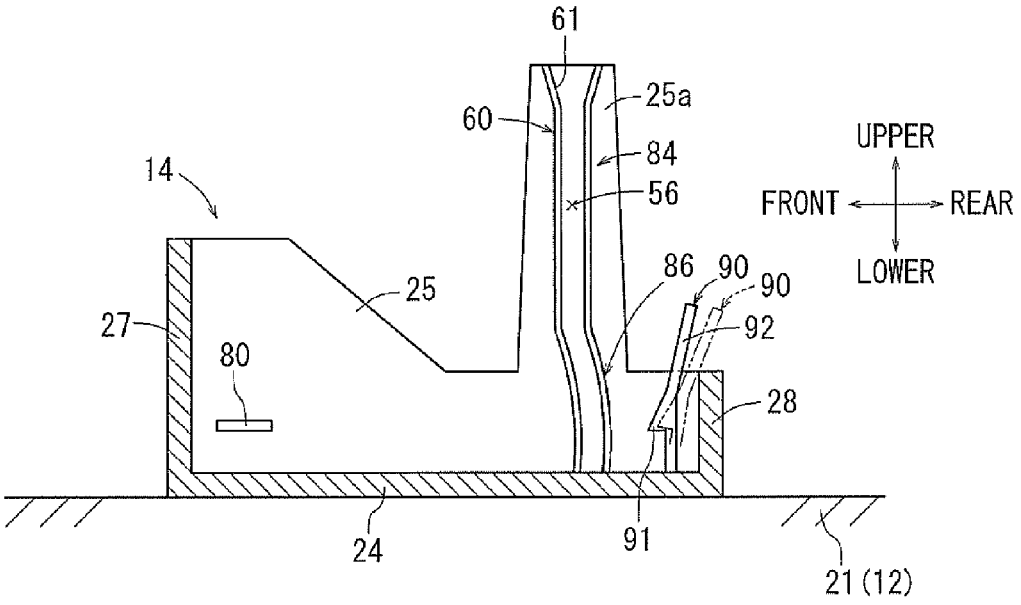
FIG. 13 is a cross-sectional view along line XIII-XIII in FIG. 12.

A third embodiment will be described based on FIGS. 11 through 15. As shown in FIG. 11, in the present embodiment, stopper pins 78 are provided to have the same configuration with the front side guide pins 51 of the first embodiment. Further, guide pins 79 are provided to have the same configurations with the rear side guide pins 53 of the first embodiment. As shown in FIGS. 12 and 13, a pair of right and left stopper pieces 80 are symmetrically provided on the inner side surfaces of the front end portions of the left-hand side plate portion 25 and the right-hand side plate portion 26 of the sub tank 14. Each of the stopper pieces 80 is formed in a plate shape protruding inwardly and extending in the front-rear direction. The stopper pins 78 correspond to the "stopper member" as referred to herein. The guide pins 79 correspond to the "slider" as referred to herein. The stopper pieces 80 correspond to the "engagement member" as referred to herein.

Figure 14:
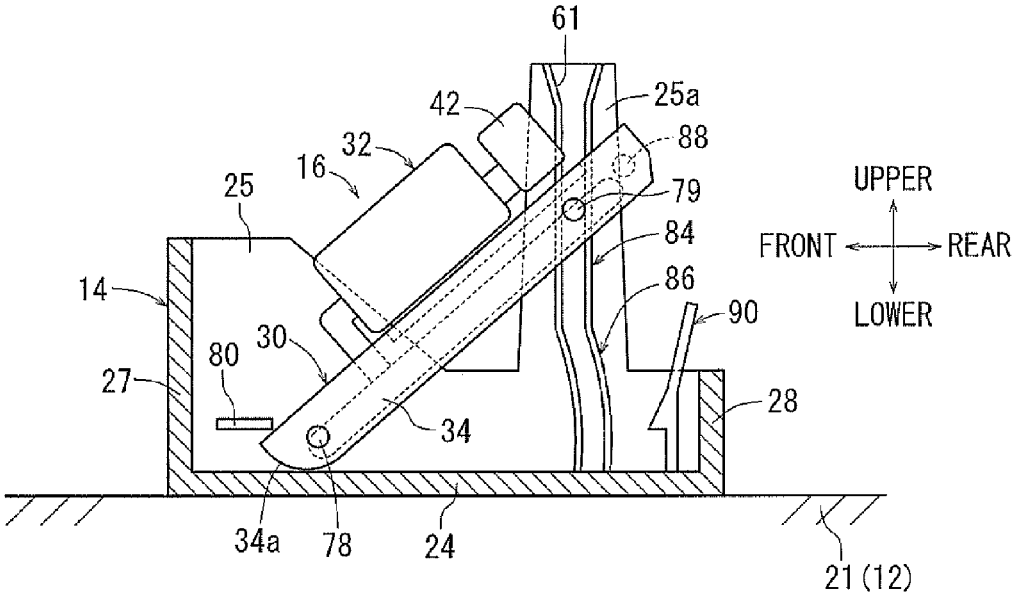
FIG. 14 is a sectional side view illustrating the first mounting process through which the pump unit is mounted to the tank main body.
Figure 15:
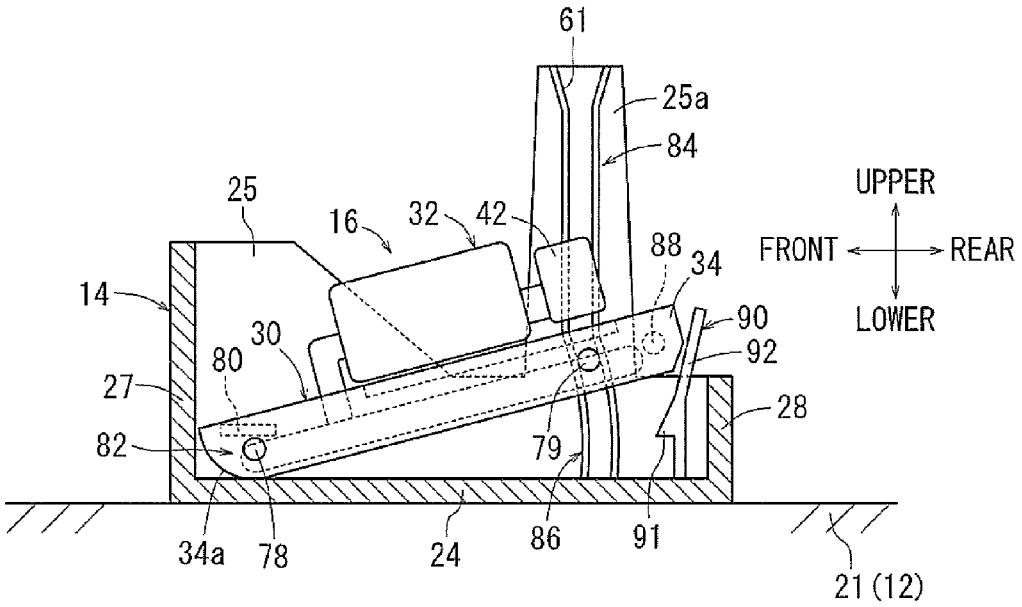
FIG. 15 is a sectional side view illustrating the second mounting process through which the pump unit is mounted to the tank main body.

The bottom plate portion 24 of the sub tank 14 guides horizontally forwards the arcuate surfaces 34*a* of the distal end portions (i.e., front end portions) of both support side plates 34 of the mount 30 of the pump unit 16 mainly in the inclined attitude as shown in FIGS. 14 and 15. The bottom plate portion 24 in the present embodiment corresponds to a "guide member" as referred to herein. Further, the bottom plate portion 24 constitutes a part of the guide means.

The distal end portions (i.e., the front end portions) of both support side plates 34 of the mount 30 of the pump unit 16 are configured to contact the front side plate portion 27 of the sub tank 14. When the distal end portions (i.e., the front end portions) of both support side plates 34 of the pump unit 16 in the inclined attitude contact the front side plate portion 27 of the sub tank 14, the stopper pins 78 are engaged with lower surfaces of the stopper pieces 80. That is, the front side plate portion 27 of the sub tank 14 and the stopper pieces 80 as the "tank main body side support portion" and the stopper pins 78 as the "pump unit side support portion" configure a rotation support means 82 and detachably engage with each other so as to be capable of mutual rotation as shown in FIG. 11. The front side plate portion 27 corresponds to the "contact member" as referred to herein.

As shown in FIG. 13, the guide rails 84 have no third guide portion corresponding to the third guide portions 62 that include the inclined portions 63 of the guide rails 55 of the first embodiment. Further, second guide portions 86 are continuously formed from the lower end portions of the first guide portions 60. Lower end portions of the second guide portions 86 extend to the bottom plate portion 24. Thus, the lower end walls 64*a* of the second guide portions 64 and the lock groove portions 65 of first embodiment are omitted in the present embodiment. The lower end portions of the second guide portions 86 may be spaced away from the bottom plate portion 24.

Each of the second guide portions 86 is formed to have a radius of curvature in conformity with rotational paths of the guide pins 79 accompanying the rotation of the pump unit 16 using the rotation support means 82 as the rotational fulcrum as shown in FIG. 15. Thus, even when the pump unit 16 is rotated from the inclined attitude to the mounting position with respect to the sub tank 14, the mount 30 undergoes no elastic deformation. That is, the present embodiment does not have the lock means 67 of the first embodiment. Instead, there is provided a lock means 94 described below.

As shown in FIG. 11, a lock bar 88 is provided to extend between the rear end portions of both support side plates 34 of the pump unit 16 in the right-left direction. Further, a rectangular-plate-like lock member 90 extends upward from the rear end portion of the bottom plate portion 24 of the sub tank 14 as shown in FIGS. 12 and 13. The lock member 90 is arranged at the central portion between the left-hand side plate portion 25 and the right-hand side plate portion 26 of the sub tank 14, and extends in the right-left direction.

As shown in FIG. 13, at a central portion of the lock member 90 in the vertical direction, there is formed a lock claw 91 protruding forwards. The lock claw 91 is formed so as to be capable of being engaged with the lock bar 88 as shown in FIG. 11. The portion of the lock member 90 protruding above the lock claw 91 serves as an operation portion 92. The lock member 90 is formed so as to be capable of elastic deformation or flexural deformation in the thickness direction or the front-rear direction as shown by the chain double-dashed line 90 in FIG. 13. That is, the lock bar 88 and the lock member 90 form the lock means 94 as shown in FIG. 11. The lock bar 88 corresponds to the "pump unit side lock portion" as referred to herein. The lock member 90 corresponds to the "tank main body side lock portion" as referred to herein.

Next, a method of mounting the pump unit 16 to the tank main body 12 will be described. The pump unit 16 is inserted into the tank main body 12 in the substantially vertical attitude in which one longitudinal end portion (i.e., the front end portion) thereof is forwardly inclined. At this time, the guide pins 79 are engaged with the first guide portions 60 via the introduction ports 61 of the guide rails 55, and are caused to move downwards along the first guide portions 60. And, when the arcuate surfaces 34*a* of both support side plates 34 of the mount 30 contact the bottom plate portion 24 of the sub tank 14, the arcuate surfaces 34*a* are caused to slide forwards along the bottom plate portion 24 as shown in FIG. 14.

Then, when the front end portion of the mount 30 contacts the front side plate portion 27 of the sub tank 14 and when the stopper pins 78 are engaged with the stopper pieces 80 of the sub tank 14, the pump unit 16 is in the inclined attitude as shown in FIG. 15. And, the pump unit 16 is caused to rotate downwards using as the rotational fulcrum the rotation support means 82 formed by the engagement between the front side plate portion 27 and the stopper pieces 80 and the stopper pins 78. That is, the rear end portion of the pump unit 16 is pressed down. Then, the guide pins 79 slide on the second guide portions 86. When the lock bar 88 of the mount 30 contacts the lock claw 91 of the lock member 90 of the sub tank 14, the lock member 90 undergoes elastic deformation backwards as shown by the chain double-dashed line 90 in FIG. 13, and the lock member 90 is elastically restored simultaneously with the passing of the lock bar 88 by the lock claw 91, with the result that the lock claw 91 is brought into engagement with or into so-called snap-fit engagement with the lock bar 88 as shown in FIG. 11. As a result, the pump unit 16 is locked to the tank main body 12.

When the pump unit 16 is to be removed, the engagement of the lock claw 91 with respect to the lock bar 88 is released by backwardly pushing the operation portion 92 of the lock member 90 as shown by the chain double-dashed line 90 in FIG. 13, and then the pump unit 16 is caused to rotate upwards using the rotation support means 82 as the rotational fulcrum. That is, the rear end portion of the pump unit 16 is raised. Then, the pump unit 16 is removed in an order reverse to that at the time of its insertion.

In the fuel tank 10 of the present embodiment, when mounting the pump unit 16 in the tank main body 12, the guide pins 79 are guided by the guide rails 55 of the guide means, and the arcuate surfaces 34*a* of the mount 30 are guided by the bottom plate portion 24 of the sub tank 14. As a result, the pump unit 16 is guided to the mounting position on the bottom portion side from the tank hole 22 side of the tank main body 12. Thus, it is possible to properly move the pump unit 16 to the mounting position easily without being at a loss. As a result, it is possible to shorten the operation time, and to suppress defective mounting of the pump unit 16. Thus, it is possible to achieve an improvement in terms of the mounting property and mounting operations of the pump unit 16 with respect to the tank main body 12.

Further, through the engagement between the front side plate portion 27 and the stopper pieces 80 (i.e., the tank main body side support portion) of the rotation support means 82 and the stopper pins 78 (i.e., the pump unit side support portions) it is possible to rotatably support one longitudinal end portion (i.e., the front end portion) of the pump unit 16 as shown in FIGS. 11 and 15. When bringing the pump unit 16 to the mounting position with respect to the sub tank 14, which is shown in FIG. 11, from the inclined attitude shown in FIG. 15, the pump unit 16 is caused to rotate downwards using the rotation support means 82 as the rotational fulcrum, whereby the guide pins 79 are guided by the second guide portions 86 of the guide rails 55. Thus, it is possible to easily move the pump unit 16 to the mounting position with respect to the sub tank 14.

When the pump unit 16 is brought to the mounting position with respect to the sub tank 14, the lock bar 88 is engaged with the lock member 90 of the lock means 94 by utilizing the elastic deformation of the lock member 90, whereby the pump unit 16 is locked to the tank main body 12 as shown in FIG. 11. Further, by releasing the engagement of the lock bar 88 with the lock member 90 by utilizing the elastic deformation of the lock member 90, it is possible to remove the pump unit 16 in an order reverse to that at the time of the insertion thereof. Thus, it is possible to detachably mount the pump unit 16 to the tank main body 12. The lock bar 88 may be formed so as to be capable of elastic deformation. Further, the lock bar 88 may be arranged as the tank main body side lock portion of the sub tank 14, and the lock member 90 may be arranged as the pump unit side lock portion of the pump unit 16.

Further, the bottom plate portion 24 of the sub tank 14 provided at the bottom portion of the tank main body 12 is configured to guide horizontally forwards the arcuate surfaces 34*a* at the distal end portion (i.e., the front end portion) of the pump unit 16 in the vertical attitude or in the substantially vertical attitude. Further, the bottom plate portion 24 of the sub tank 14 also serves as the guide member, whereby there is no need to provide a dedicated guide member. A dedicated guide member may be arranged on the bottom plate portion 24 of the sub tank 14.

Figure 16:
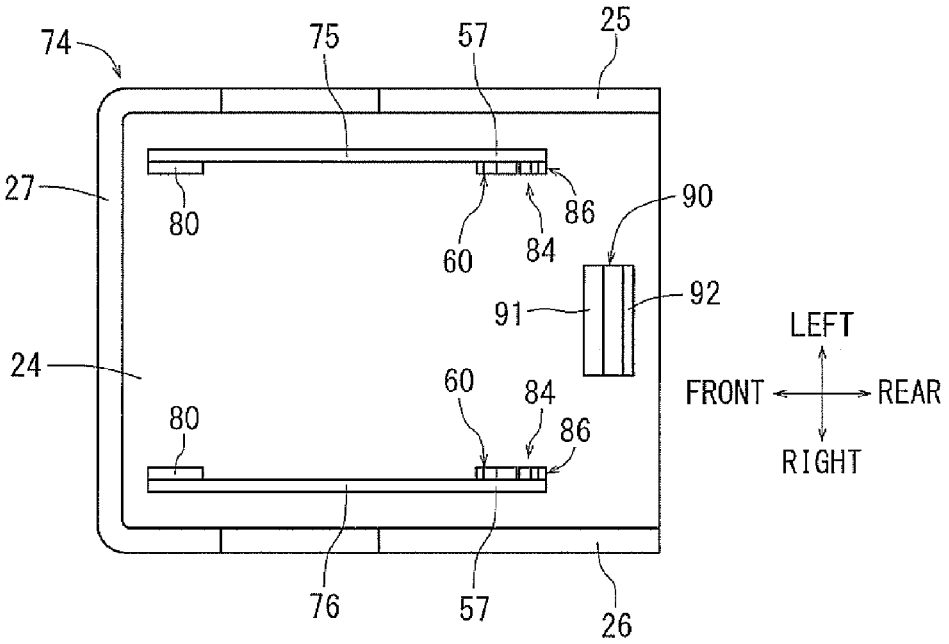
FIG. 16 is a plan view of the sub tank according to a fourth embodiment.

A fourth embodiment will be described based on FIG. 16. The fourth embodiment corresponds to the second embodiment having some changes. As shown in FIG. 16, in the present embodiment, there are symmetrically provided the guide rails 84 and the stopper pieces 80 of the third embodiment on the opposing side surfaces of the left side plate 75 and the right side plate 76 of the sub tank 74 instead of the guide rails 55 of the second embodiment. The pump unit 16 of the third embodiment can be commonly used for the present embodiment. The left side plate 75 and the right side plate 76 equipped with the guide rails 84 and the stopper pieces 80 may be arranged on the bottom surface portion 21 of the tank main body 12. Further, the lock member 90 may be arranged on the bottom surface portion 21 of the tank main body 12. In this case, the bottom surface portion 21 of the tank main body 12 may also serve as the guide member. Further, a dedicated guide member may be arranged on the bottom surface portion 21 of the tank main body 12. Further, the guide rails 84 and the stopper pieces 80 may be independently arranged on the bottom surface portion 24 of the sub tank 14 or the bottom surface portion 21 of the tank main body 12.

Figure 17:
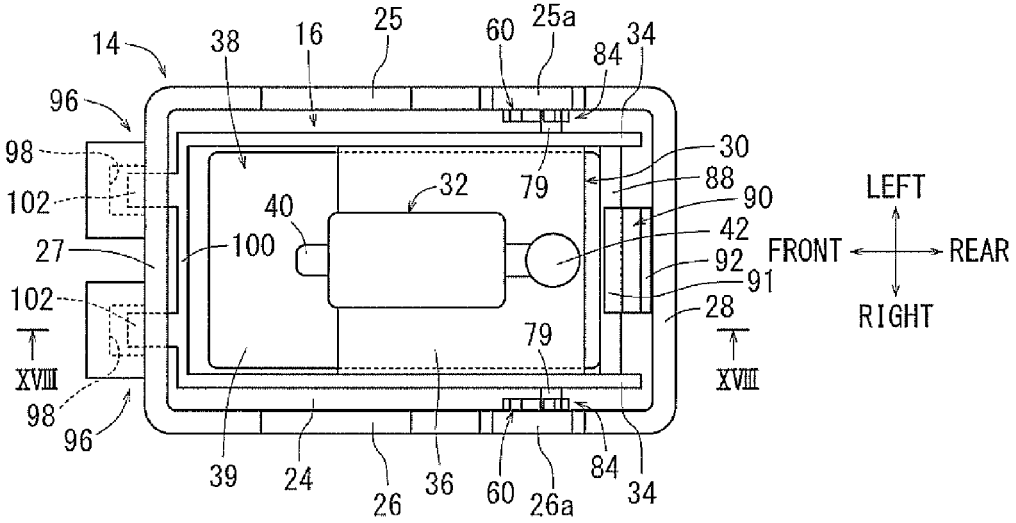
FIG. 17 is a plan view of the pump unit mounted to the sub tank according to a fifth embodiment.
Figure 18:
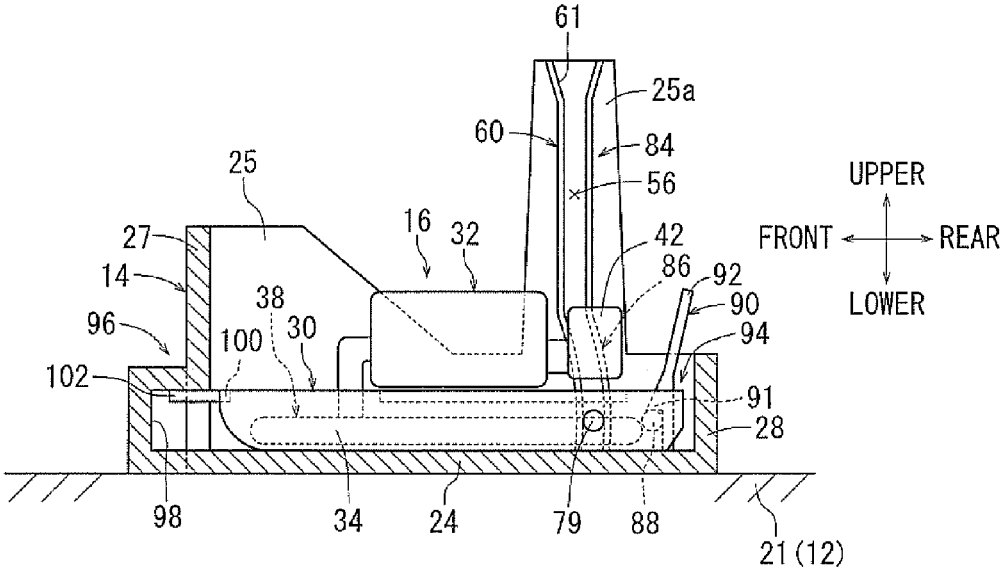
FIG. 18 is a cross-sectional view along line XVIII-XVIII in FIG. 17.
Figure 19:
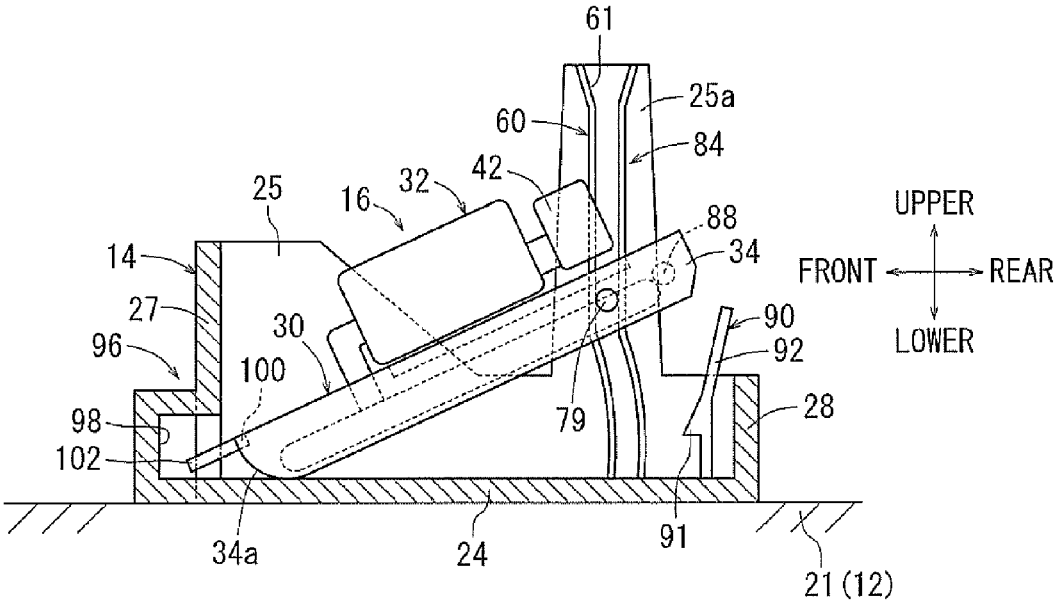
FIG. 19 is a sectional side view illustrating the mounting process through which the pump unit is mounted to the tank main body.

A fifth embodiment will be described based on FIGS. 17 through 19. As shown in FIGS. 17 and 18, in the present embodiment, the rotation support means 82 of the third embodiment is changed to a rotation support means 96. Further, the stopper pieces 80 of the sub tank 14 and the right and left stopper pins 78 of the mount 30 of the third embodiment are omitted.

Right and left lock recesses 98 are formed in the front side plate portion 27 of the sub tank 14. Both lock recesses 98 are formed as laterally oriented, bottomed rectangular tubes that are open rearwards. Further, between the front end portions (i.e., the distal end portions) of both support side plates 34 of the mount 30, there is provided a lateral extension member 100. The lateral extension member 100 has right and left protrusion-piece-like lock protrusions 102. The right and left lock protrusions 102 are formed so as to be capable of engagement with the right and left lock recesses 98 of the sub tank 14. The lock recesses 98 correspond to the "tank main body side lock portion," and the "tank main body side support portion" as referred to herein. The lock protrusions 102 correspond to the "pump unit side lock portion," and the "pump unit side support portion," as referred to herein. Further, the rotation support means 96 capable of mutual rotation and detachable engagement are formed by the lock recesses 98 and the lock protrusions 102. Although there are provided two right and left rotation support means 96 in the present embodiment, the number of rotation support means 96 may be increased or decreased as appropriate.

In the fuel tank 10 of the present embodiment, through the engagement between the lock recesses 98 (i.e., the tank main body side support portions) and the lock protrusions 102 (i.e., the pump unit side support portions) of the rotation support means 96, it is possible to rotatably support one longitudinal end portion (i.e., the front end portion) of the pump unit 16. The lock protrusions 102 may be arranged as the tank main body side lock portions of the sub tank 14, and the lock recesses 98 may be arranged as the pump unit side lock portions of the mount 30.

Figure 20:
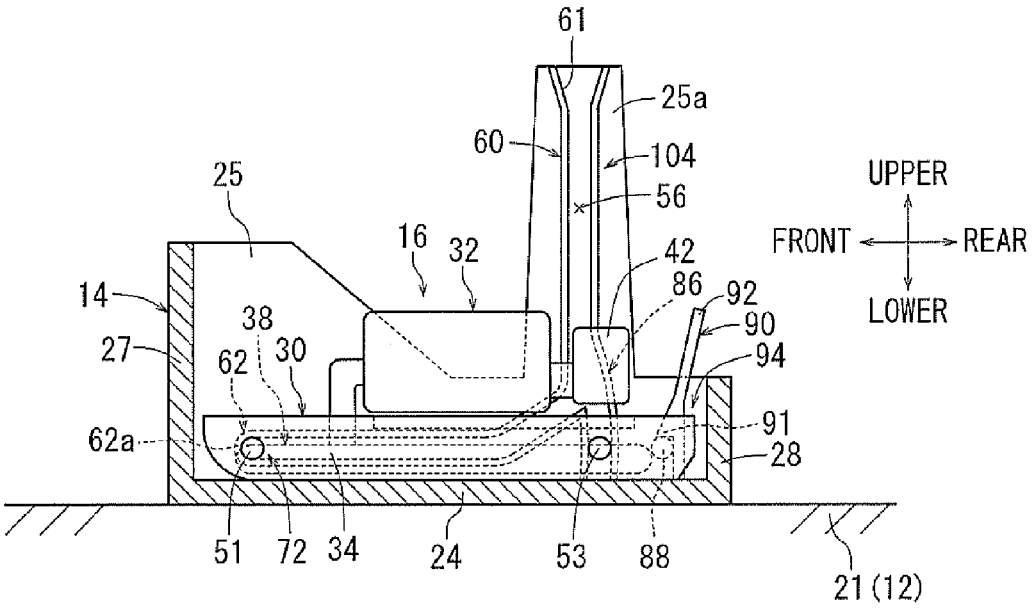
FIG. 20 is a sectional side view of the pump unit mounted to the sub tank according to a sixth embodiment.

A sixth embodiment will be described based on FIG. 20. As shown in FIG. 20, the sub tank 14 and the pump unit 16 of the present embodiment are same with those of the first embodiment. And, each guide rail 104 of the present embodiment has the second guide portion 86 of the third embodiment instead of the second guide portion 64 of the first embodiment. Further, between the sub tank 14 and the pump unit 16, there is provided the lock means 94 of the third embodiment.

Figure 21:
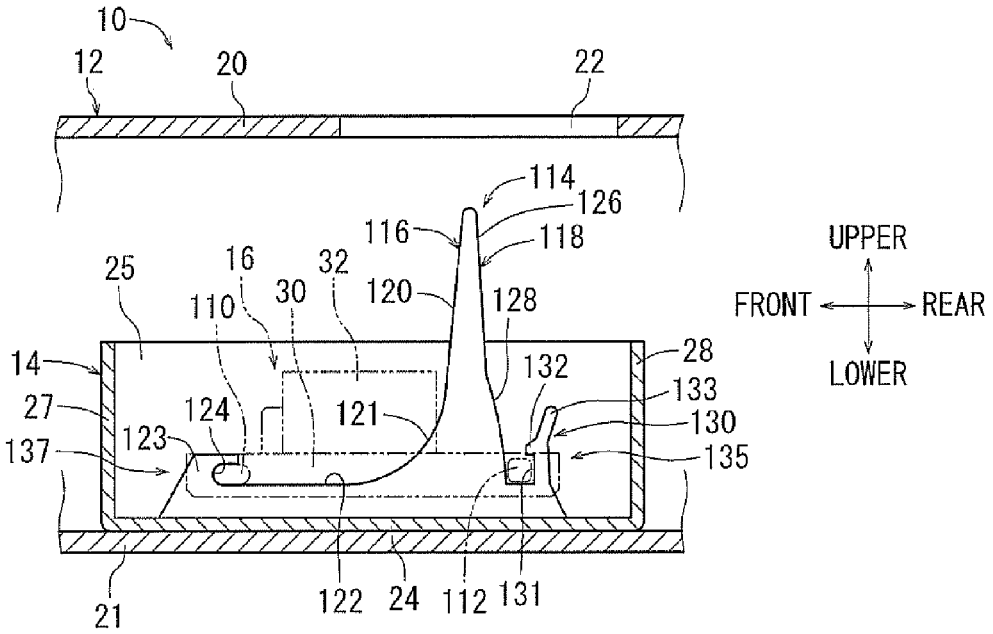
FIG. 21 is a sectional side view of a main portion of the fuel tank according to a seventh embodiment.

A seventh embodiment will be described based on FIGS. 21 and 22. As shown in FIG. 21, each front side guide pin 110 of the mount 30 of the pump unit 16 of the present embodiment is formed, for example, in an elongated-round-shaft-like configuration having a cross-section elongated in a direction parallel to the longitudinal direction of the mount 30. Each rear side guide pin 112 of the mount 30 is formed, for example, in a rectangular-shaft-like configuration.

The guide rails 114 of the present embodiment are provided symmetrically on the bottom plate portion 24 of the sub tank 14 having the same configuration with that of the first embodiment. Because the right and left guide rails 114 symmetrically have the same configurations with each other, a detailed configuration of the left guide rail 114 shown in FIG. 21 will be described, whereas that of the right guide rail 114 will not be described. The left guide rail 114 is formed in a chevron-shaped configuration having a front side guide surface 116 and a rear side guide surface 118. The upper end portion of the guide rail 114 extends above the upper limit of the sub tank 14 capable of storing the fuel in the horizontal state. Further, the upper end portion of the guide rail 114 extends to a position near the central portion of the tank hole 22 of the tank main body 12.

The front side guide surface 116 extends obliquely forwards from the tank hole 22 side of the tank main body 12 toward the bottom portion side. The front side guide surface 116 has a front side upstream guide portion 120 consisting of an abrupt slope, and a front side downstream guide portion 122 continuous with the lower end portion of the front side upstream guide portion 120 via an inclined guide portion 121 and extending forwards. The inclined guide portion 121 is formed in a recessed arcuate configuration. At the front end portion of the guide rail 114, there is formed a lock wall portion 123 continuous with the front side downstream guide portion 122 and having a U-shaped lock groove 124 backwardly open.

The rear side guide surface 118 extends obliquely rearwards from the tank hole 22 side of the tank main body 12 toward the bottom portion side. The rear side guide surface 118 has a rear side upstream guide portion 126 consisting of an abrupt slope, and an arcuate rear side downstream guide portion 128 continuous with the rear side upstream guide portion 126. The rear side downstream guide portion 128 is formed to have a radius of curvature substantially in conformity with the rotational path of the rear side guide pin 112 accompanying the vertical rotation of the mount 30 around the front side guide pin 110 in the state in which the front side guide pin 110 is engaged with the lock wall portion 123. The front and rear upstream guide portions 120 and 126, respectively, are formed symmetrically with respect to the front-rear direction.

At the rear end portion of the guide rail 114, there is formed a lock portion 130 continuous with the lower end of the rear side downstream guide portion 128 and having a lock groove 131 formed in a rectangular groove shape upwardly open. The lock portion 130 has a forwardly protruding lock claw 132. The portion of the lock portion 130 protruding above the lock claw 132 serves as an operation portion 133. The lock portion 130 is formed so as to be capable of elastic deformation or flexural deformation in the front-rear direction as shown by the chain double-dashed line 130 in FIG. 22. The lock claw 132 is formed so as to be capable of utilizing the elastic deformation of the lock portion 130 in order to engage with the rear side guide pin 112 that is received in the lock groove 131.

As shown in FIG. 21, the rear side guide pin 112 and the lock portion 130 form a lock means 135. Further, the lock wall portion 123 as the "tank main body side support portion" and the front side guide pin 110 as the "pump unit side support portion" form a rotation support means 137 such that the lock wall portion 123 and the front side guide pin 110 detachably engage with each other so as to be capable of mutual rotation. Further, a combination of the guide pins 110 and 112 and the guide rail 114 forms a guide means. Thus, a pair of the guide means are arranged symmetrically in the right-left direction although the left one is shown in FIGS. 21 and 22.

In the present embodiment, the upper end surfaces of the left-hand side plate portion 25, the right-hand side plate portion (not shown), the front side plate portion 27 and the rear side plate portion 28 of the sub tank 14 are formed in the same height. The left-hand side plate portion 25 and the right-hand side plate portion do not have protrusion corresponding to the protrusions 25*a* and 26*a* of the first embodiment. Further, in the state in which the pump unit 16 is mounted to the sub tank 14 as shown in FIG. 21, the front end portion of the mount 30 may not come close to or contact the front side plate portion 27. Further, the rear end portion of the mount 30 may not come close to or contact the rear side plate portion 28. Further, the present embodiment does not have the arcuate surface 34*a* and the inclined surface 34*b* of the first embodiment. The flange unit 18, the support side plate 34 and the base plate 36 of the pump unit 16, the fuel filter 38, the pressure regulator 42 and other components are not shown in FIGS. 21 and 22.

The front side guide pin 110 corresponds to the "slider," the "preceding side slider," and the "pump unit side support portion" as referred to herein. The rear side guide pin 112 corresponds to the "slider," and the "succeeding side slider" as referred to herein. The rear side guide pin 112 corresponds to the "pump unit side lock portion" as referred to herein. The front side upstream guide portion 120 and the rear side upstream guide portion 126 correspond to the "first guide portion" as referred to herein. The front side downstream guide portion 122 corresponds to the "third guide portion" as referred to herein. The rear side downstream guide portion 128 corresponds to the "second guide portion" as referred to herein. The lock portion 130 corresponds to the "tank main body side lock portion" as referred to herein.

Next, a method of mounting the pump unit 16 to the tank main body 12 will be described. The pump unit 16 is inserted into the tank main body 12 in the substantially vertical attitude in which one longitudinal end portion (i.e., the front end portion) thereof is inclined obliquely forwards. At this time, the front side guide pins 110 are engaged with the upstream guide portions 120 of the guide rails 114 of the sub tank 14, and are caused to slide downwards along the front side upstream guide portions 120. Subsequently, the front side guide pins 110 are caused to slide from the front side upstream guide portions 120 to the inclined guide portions 121 as shown in FIG. 22. In this state, while causing the front side guide pins 110 to move forwards along the front side downstream guide portions 122, the rear side guide pins 112 are engaged with the rear side upstream guide portions 126 of the guide rails 114, and are caused to slide downwards along the rear side upstream guide portions 126. Then, the front side guide pins 110 are engaged with the lock grooves 124 of the lock wall portions 123 of the guide rails 114.

Subsequently, using the rotation support means 137 formed by the engagement between the lock wall portions 123 and the front side guide pins 110 as the rotational fulcrum, the pump unit 16 is rotated downwards. That is, the rear end portion of the pump unit 16 is pressed down. Then, the rear side guide pins 112 slide on the downstream guide portions 128. And, when the rear side guide pins 112 contact the lock claws 132 of the lock portions 130 of the guide rails 114, the lock portions 130 undergo rearward elastic deformation as shown by the chain double-dashed line 130 in FIG. 22, and the lock claws 132 are engaged with or undergo snap-fit engagement with the rear side guide pins 112 as shown in FIG. 21. As a result, the pump unit 16 is locked to the tank main body 12.

Figure 22:
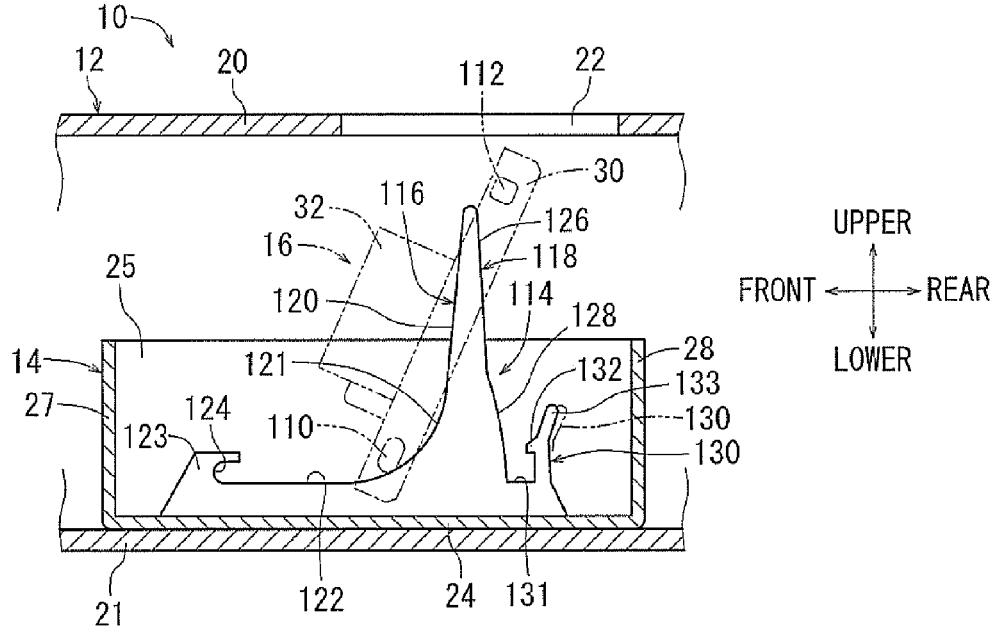
FIG. 22 is a sectional side view illustrating the mounting process through which the pump unit is mounted to the tank main body.

When the pump unit 16 is to be removed, the lock claws 132 are disengaged from the rear side guide pins 112 by backwardly pressing the operation portions 133 of the lock portions 130 as shown by the chain double-dashed line 130 of FIG. 22, and then the pump unit 16 is upwardly rotated using the rotation support means 137 as the rotational fulcrum. That is, the rear end portion of the pump unit 16 is raised. Then, the pump unit 16 is removed in an order reverse to that at the time of its insertion.

In the fuel tank 10 described above, when mounting the pump unit 16 in the tank main body 12, both guide pins 110 and 112 are guided by the guide rails 114 of the guide means. Due to this construction, the pump unit 16 is guided from the tank hole 22 side of the tank main body 12 to the mounting position at the bottom portion side. Thus, it is possible to properly move the pump unit 16 to the mounting position easily without being at a loss. As a result, it is possible to shorten the operation time, and to suppress defective mounting of the pump unit 16. Thus, it is possible to achieve an improvement in terms of the mounting property and mounting operations of the pump unit 16 with respect to the tank main body 12.

Further, the rotation support means 137 rotatably supporting one longitudinal end portion of the pump unit 16 are formed by the lock wall portions 123 (i.e., the tank main body support portions) provided on the tank main body 12, and the front side guide pins 110 (i.e., the pump unit side support portions) provided on the pump unit 16 and configured to be engaged with the lock wall portions 123. Further, the guide rails 55 are provided with the front side upstream guide portions 120 and the rear side upstream guide portions 126 that extend to the bottom portion side from the tank hole 22 side of the tank main body 12. Thus, it is possible to guide the front side guide pins 110 and the rear side guide pins 112 of the pump unit 16 from the tank hole 22 side of the tank main body 12 to the bottom portion side thereof. Further, through the engagement between the lock wall portions 123 (i.e., the tank main body side support portions) and the front side guide pins 110 (i.e., the pump unit side support portions) of the rotation support means 137, it is possible to rotatably support one longitudinal end portion (i.e., the front end portion) of the pump unit 16. Thus, using the rotational support means 137 as the rotational fulcrum, it is possible to easily rotate the pump unit 16 to the mounting position on the bottom portion side of the tank main body 12.

Further, there are provided the rear side downstream guide portions 128 which are continuous with the bottom portion side end portions of the rear side upstream guide portions 126 and which guide the rear side guide pins 112 when rotating the pump unit 16 downwards using the rotation support means 137 as the rotational fulcrum. Thus, by rotating the pump unit 16 using the rotation support means 137 as the rotational fulcrum, the rear side guide pins 112 are guided by the rear side downstream guide portions 128 of the guide rails 114. Thus, it is possible to easily move the pump unit 16 to the mounting position on the bottom portion side of the tank main body 12.

Further, between the tank main body 12 and the pump unit 16, there are provided the lock means 135 configured to effect mutual engagement when the pump unit 16 is rotated to the mounting position on the bottom portion side of the tank main body 12 using the rotation support means 137 as the rotational fulcrum. The lock means 135 include the lock portions 130 provided on the tank main body 12, and the rear side guide pins 112 provided on the pump unit 16 and configured to be engaged with the lock portions 130. The lock portions 130 and the rear side guide pins 112 are formed so as to be capable of engagement with each other by utilizing the elastic deformation of the lock portions 130. Thus, when the pump unit 16 is rotated to the mounting position on the bottom portion side of the tank main body 12, the rear side guide pins 112 are engaged with the lock portions 130 of the lock means 135 by utilizing the elastic deformation of the lock portions 130, whereby the pump unit 16 is locked to the tank main body 12. Further, by releasing the engagement of the rear side guide pins 112 with the lock portions 130 by utilizing the elastic deformation of the lock portions 130, it is possible to remove the pump unit 16 in an order reverse to that at the time of the insertion thereof. Thus, it is possible to detachably mount the pump unit 16 to the tank main body 12.

Further, there are provided the front side guide pins 110 at one longitudinal end portion of the pump unit 16, and the guide rails 114 are provided with the front side downstream guide portions 122 continuous with the bottom portion side end portions of the front side upstream guide portions 120 via the inclined guide portions 121 and configured to guide the front side guide pins 110 to predetermined positions along the bottom portion of the tank main body 12. Thus, it is possible to guide the front side guide pins 110 toward the rotation support means 137 by using the front side downstream guide portions 122 of the guide rails 55.

Further, the front side guide pins 110 also serve as the pump unit side support portions of the rotation support means 137. Thus, there is no need to provide any special member as the pump unit side support portion. Further, the lock wall portions 123 are used as the tank main body side support portions of the rotation support means 137, whereby there is no need to provide any special member as the tank main body portion side support portion.

Figure 23:
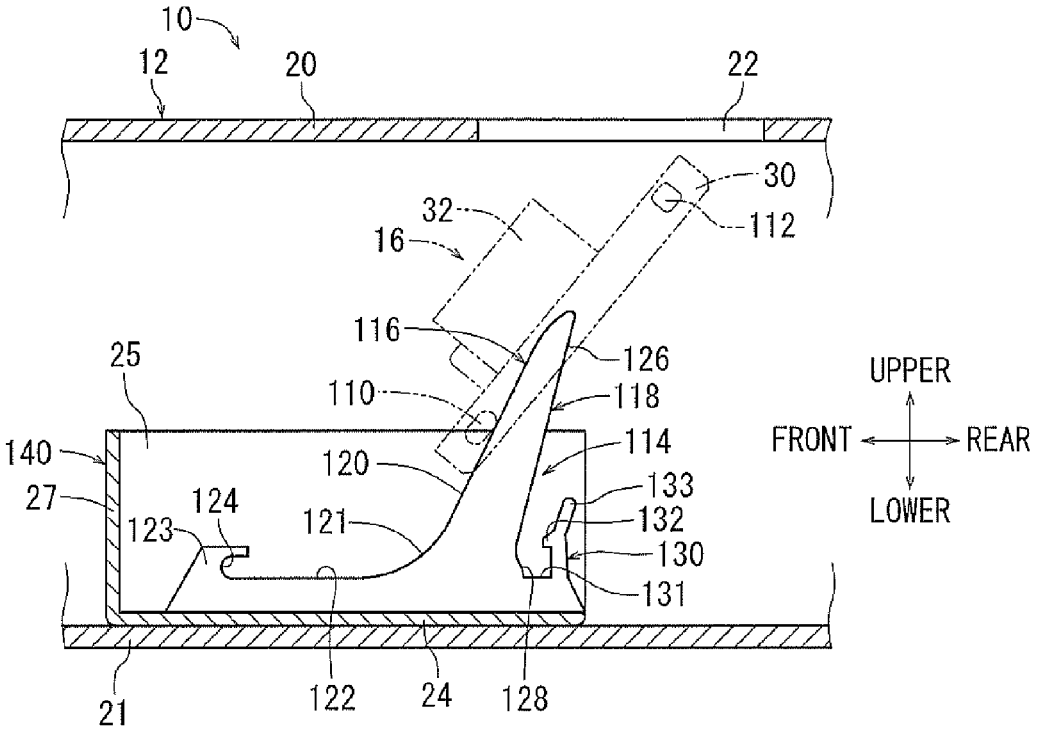
FIG. 23 is a sectional side view of the main portion of the fuel tank according to an eighth embodiment.

An eighth embodiment will be described based on FIG. 23. As shown in FIG. 23, in the present embodiment, the sub tank 140 and the tank hole 22 are arranged so as to be offset in the front-rear direction compared with those of the seventh embodiment. And, the chevron shape formed by both guide surfaces 116 and 118 of the guide rails 114 are formed such that each upper end portion thereof is inclined so as to extend toward a position near the lower side of the central portion of the tank hole 22 of the tank main body 12.

Thus, although the sub tank 140 and the tank hole 22 are arranged so as to be offset with respect to each other, it is possible to easily mount the pump unit 16 in the tank main body 12. Further, the sub tank 140 of the present embodiment does not include a rear side plate portion corresponding to the rear side plate portion 28 of the seventh embodiment.

Figure 24:
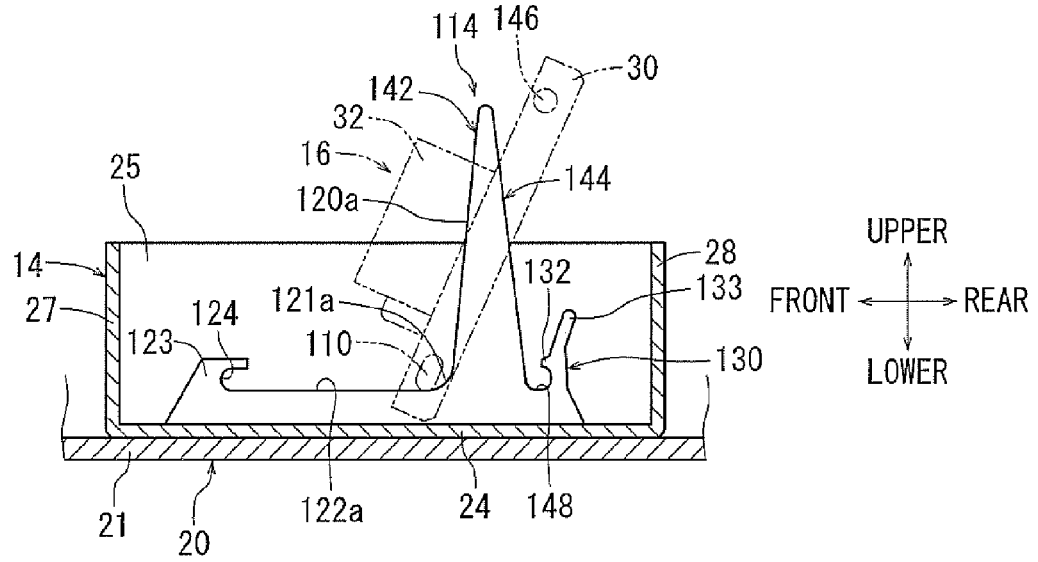
FIG. 24 is a sectional side view of the main portion of the fuel tank according to a ninth embodiment.

A ninth embodiment will be described based on FIG. 24. The ninth embodiment corresponds to the seventh embodiment having some changes. As shown in FIG. 24, in the present embodiment, each of the front side guide surfaces 116 of the guide rails 114 of the seventh embodiment is changed to a front side guide surface 142 having a simplified configuration. That is, the radius of curvature of each inclined guide portion 121*a* is diminished, and each of the front side upstream guide portion 120*a* and the front side downstream guide portion 122*a* is formed in a linear configuration. Further, each of the rear side guide surfaces 118 of the seventh embodiment is changed to a rear guide surface 144 having a simplified configuration. That is, each rear side guide surface 144 is formed in a linear configuration from the upper end to the lower end thereof. The rear side guide surfaces 144 correspond to the "first guide portion" as referred to herein.

Further, in the present embodiment, the rear side guide pins 112 of the mount 30 of the seventh embodiment are changed, for example, to round-shaft-like rear side guide pins 146. With this, the lock grooves 148 of the guide rails 114 are each formed as a U-shaped groove. The rear side guide pins 146 correspond to the "slider," the "succeeding side slider," and the "pump unit side lock portion" as referred to herein.

Figure 25:
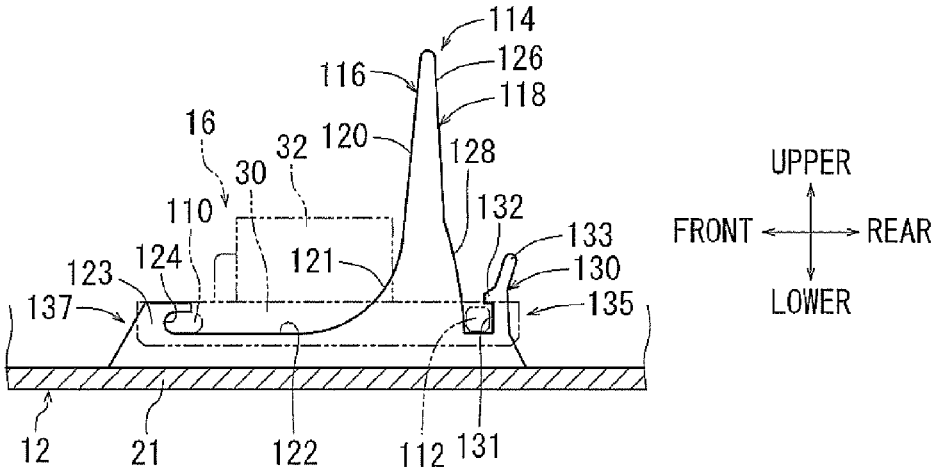
FIG. 25 is a sectional side view of the main portion of the fuel tank according to a tenth embodiment.

A tenth embodiment will be described based on FIG. 25. The tenth embodiment corresponds to the seventh embodiment having some changes. As shown in FIG. 25, in the present embodiment, the sub tank 14 of the seventh embodiment is omitted, and the guide rails 114 are arranged on the bottom surface portion 21 of the tank main body 12.

Figure 26:
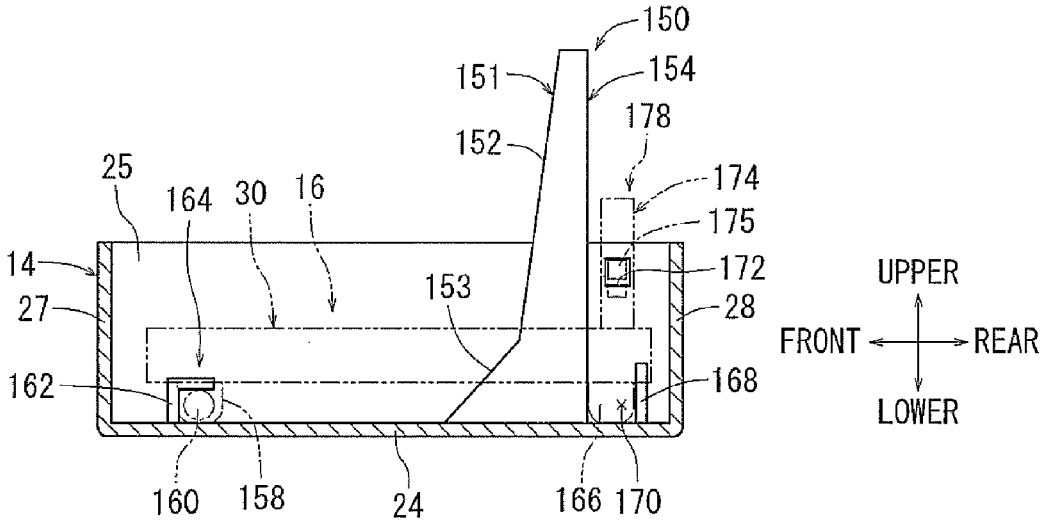
FIG. 26 is a sectional side view of the main portion of the fuel tank according to an eleventh embodiment.

An eleventh embodiment will be described based on FIGS. 26 through 29. As shown in FIG. 26, in the present embodiment, the guide rails 114 of the seventh embodiment are changed to the guide rails 150 such that the front side downstream guide portions 122, the lock wall portions 123, and the lower end portions including the lock portions 130 of the guide rails 114 are omitted.

Figure 27:
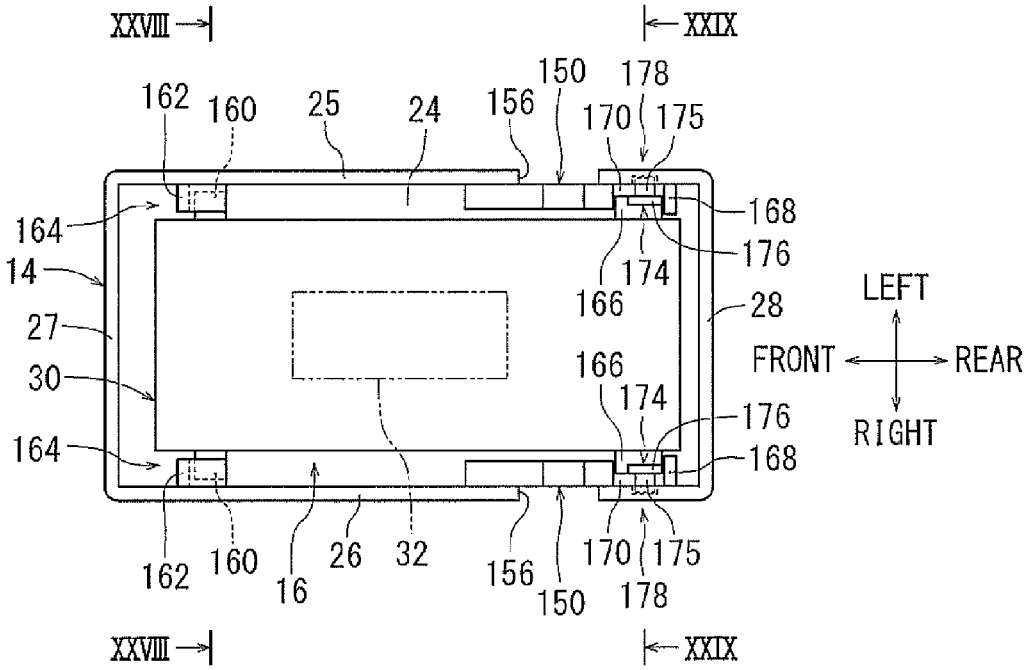
FIG. 27 is a plan view of the pump unit mounted to the sub tank.

Each of the front side upstream guide portions 152 of the front side guide surfaces 151 of the guide rails 150 is formed in a linear configuration. Further, each of the inclined guide portions 153 is formed in a linear configuration. The rear side guide surfaces 154 are formed linearly to extend in the vertical direction from the upper end to the lower end. A pair of the guide rails 150 are arranged along the inner side surfaces of the left-hand side plate portion 25 and the right-hand side plate portion 26 of the sub tank 14, respectively. As shown in FIG. 27, the left-hand side plate portion 25 and the right-hand side plate portion 26 have cutouts 156 closed by the guide rails 150. The cutouts 156 may be omitted.

Figure 28:
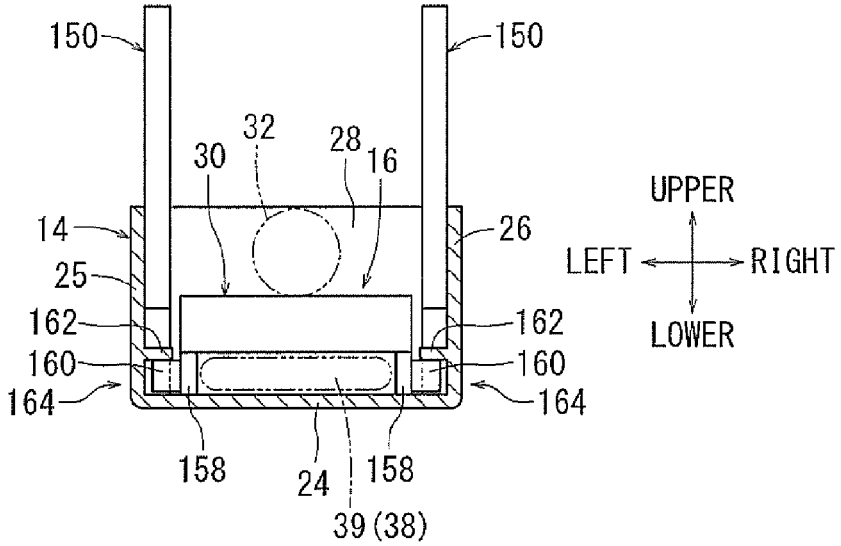
FIG. 28 is a cross-sectional view along line XXVIII-XXVIII in FIG. 27.

As shown in FIG. 28, at both right and left side end portions of the front portion of the mount 30, there are provided a pair of right and left leg pieces 158 protruding downwards. The leg pieces 158 are formed as rectangular plates, and each of front and rear corner portions at lower end portions thereof are rounded into a semi-arcuate configuration as shown in FIG. 26. The front side guide pins 160 are arranged on the outer side surfaces of the leg pieces 158.

As shown in FIGS. 27 and 28, a pair of right and left lock pieces 162 are symmetrically provided on the front portion of the bottom plate portion 24 of the sub tank 14. The left-hand side lock piece 162 is arranged at a corner portion formed by the bottom plate portion 24 of the sub tank 14 and the left-hand side plate portion 25. The right-hand side lock piece 162 is arranged at a corner portion formed by the bottom plate portion 24 of the sub tank 14 and the right-hand side plate portion 26. Each of the lock pieces 162 is formed in an L-shaped configuration open rearwards (i.e., extending upwards and bending rearwards) so as to be engaged with the guide pins 160 from the rear as shown in FIG. 26. The lock pieces 162 as the "tank main body side support portion" and the guide pins 160 as the "pump unit side support portion" form a rotation support means 164 capable of mutual rotation and detachable engagement.

Figure 29:
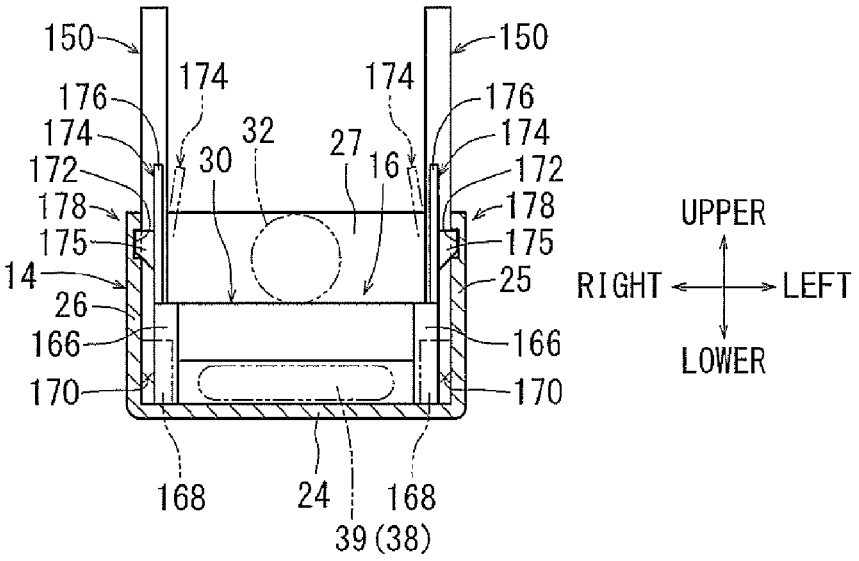
FIG. 29 is a cross-sectional view along XXIX-XXIX in FIG. 27.

As shown in FIG. 27, a pair of right and left guide pieces 166 are provided on the right and left side surfaces of the rear end portion of the mount 30. The guide pieces 166 are formed as vertically elongated rectangular plates each having a lower end portion protruding below the mount 30 as shown in FIG. 26. Each of front and rear corner portions of the lower end portions of the guide pieces 166 is rounded into a semi-arcuate configuration. Further, a pair of right and left regulation pieces 168 are symmetrically provided on the rear portion of the bottom plate portion 24 of the sub tank 14 as shown in FIG. 29. The left regulation piece 168 is disposed at a corner portion formed by the bottom plate portion 24 and the left-hand side plate portion 25 of the sub tank 14. The right regulation piece 168 is disposed at a corner portion formed by the bottom plate portion 24 and the right-hand side plate portion 26 of the sub tank 14. Both regulation pieces 168 are formed as protrusion pieces facing the rear side guide surfaces 154 of both guide rails 150 as shown in FIG. 26. On the bottom plate portion 24 of the sub tank 14, engagement grooves 170 enabling the guide pieces 166 to be engaged from above are formed between both regulation pieces 168 and both guide rails 150.

As shown in FIGS. 26 and 29, lock recesses 172 are formed at the inner side surfaces of the rear upper portions of the left-hand side plate portion 25 and the right-hand side plate portion 26 of the sub tank 14. While the lock recesses 172 are formed as lateral bottomed holes, they may also be formed as through-holes. On the other hand, a pair of right and left lock pieces 174 are symmetrically provided on both guide pieces 166 of the mount 30. At the central portion of each lock piece 174, there is formed an outwardly protruding lock claw 175. The portion of each lock piece 174 protruding above the lock claw 175 serves as an operation portion 176. Each of the lock pieces 174 is formed so as to be capable of elastic deformation or flexural deformation in the right-left direction shown by the chain double-dashed line 176 in FIG. 29. Each of the lock claws 175 is formed so as to be capable of being engaged with the lock recess 172 of the sub tank 14 by utilizing the elastic deformation of the corresponding lock piece 174. A lock means 178 is formed by the lock recesses 172 and the lock pieces 174.

The rear side guide surface 154 corresponds to the "first guide portion" as referred to herein. The guide pins 160 correspond to the "slider," the "preceding side slider," and the "pump unit side support portion" as referred to herein. The guide pieces 166 correspond to the "slider," and the "succeeding side slider" as referred to herein. The lock recesses 172 correspond to the "pump unit side lock portion" as referred to herein. The lock pieces 174 correspond to the "tank main body side lock portion" as referred to herein. The bottom surface portion 21 of the tank main body 12 corresponds to the "guide member" as referred to herein.

Next, a method of mounting the pump unit 16 to the tank main body 12 will be described. The pump unit 16 is inserted into the tank main body 12 in the substantially vertical attitude in which one longitudinal end portion (i.e., the front end portion) thereof is inclined obliquely forwards. At this time, the guide pins 160 are engaged with the front side upstream guide portions 152, and are caused to slide downwards along the front side upstream guide portions 152. Subsequently, the guide pins 160 are caused to slide on the inclined guide portions 153 from the front side upstream guide portions 152. In this state, while causing the guide pins 160 to move forwards along the bottom surface portion 21 of the tank main body 12, the guide pieces 166 are engaged with the rear side guide surfaces 154 of the guide rails 150, and are caused to slide downwards along the guide surfaces 154 thereof. Then, the guide pins 160 are engaged with the lock pieces 162 of the sub tank 14.

Subsequently, using the rotation support means 164 formed by the engagement between the lock pieces 162 and the guide pins 160 as the rotational fulcrum, the pump unit 16 is caused to rotate downwards. That is, the rear end portion of the pump unit 16 is pressed downwards. And, when the lock claws 175 of the lock pieces 174 contact the left-hand side plate portion 25 and the right-hand side plate portion 26 of the sub tank 14, the lock pieces 174 undergo elastic deformation inwardly sidewise shown by the chain double-dashed line 174 in FIG. 29. Then, when the lock claws 175 are aligned with the lock recesses 172 of the sub tank 14, the lock pieces 174 undergo elastic restoration, and the lock claws 175 are engaged or snap-fit-engaged with the lock recesses 172 as shown in FIG. 29. At the same time, the guide pieces 166 are engaged with the engagement grooves 170 of the sub tank 14. As a result, the pump unit 16 is locked to the tank main body 12.

When the pump unit 16 is to be removed, the operation portions 176 of the lock pieces 174 are pushed inwardly sidewise in order to release the engagement of the lock claws 175 with the lock recesses 172. Then, the pump unit 16 is caused to rotate upwards using the rotation support means 164 as the rotational fulcrum. That is, the rear end portion of the pump unit 16 is raised. Then, the pump unit 16 is removed in an order reverse to that at the time of the insertion thereof.

In the fuel tank 10 described above, during the mounting process of the pump unit 16 into the tank main body 12, the guide pins 160 and the guide pieces 166 are guided by the guide rails 150 of the guide means. Due to this construction, the pump unit 16 is guided to the mounting position on the bottom portion side from the tank hole 22 side of the tank main body 12. Accordingly, it is possible to properly move the pump unit 16 easily to the mounting position without being at a loss. As a result, it is possible to shorten the operation time, and to suppress defective mounting of the pump unit 16. Thus, it is possible to achieve an improvement in terms of the mounting property and mounting operations of the pump unit 16 with respect to the tank main body 12.

Further, the rotation support means 164 rotatably supporting one longitudinal end portion of the pump unit 16 are formed by the lock pieces 162 (i.e., the tank main body side support portions) provided on the tank main body 12, and the guide pins 160 (i.e., the pump unit side support portions) provided on the pump unit 16 and configured to be engaged with the lock pieces 162. Further, each guide rail 150 is provided with the front side upstream guide portion 152 and the rear side guide surface 154. Thus, due to the front side upstream guide portions 152 and the rear side guide surfaces 154 of the guide rails 150, it is possible to guide the guide pins 160 and the guide pieces 166 of the pump unit 16 from the upper end portions side to the bottom portion side. Further, due to the engagement between the lock pieces 162 (i.e., the tank main body side support portions) and the guide pins 160 (i.e., the pump unit side support portions) of the rotation support means 164, it is possible to rotatably support one longitudinal end portion (i.e., the front end portion) of the pump unit 16. Thus, it is possible to rotate the pump unit 16 easily to the mounting position at the bottom portion side of the tank main body 12 using the rotation support means 164 as the rotational fulcrum.

Further, between the tank main body 12 and the pump unit 16, there is provided the lock means 178 configured to undergo mutual engagement when the pump unit 16 is rotated to the mounting position at the bottom portion side of the tank main body 12 using the rotation support means 164 as the rotational fulcrum. The lock means 178 is equipped with the lock recesses 172 on the tank main body 12, and the lock pieces 174 provided on the pump unit 16 and configured to be engaged with the lock recesses 172. The lock recesses 172 and the lock pieces 174 are formed so as to be capable of being engaged with each other by utilizing the elastic deformation of the lock pieces 174. Thus, when the pump unit 16 is rotated to the mounting position at the bottom portion side of the tank main body 12, the lock pieces 174 are engaged with the lock recesses 172 of the lock means 178 by utilizing the elastic deformation thereof, whereby the pump unit 16 is locked to the tank main body 12. Further, by releasing the engagement of the lock pieces 174 with the lock recesses 172 by utilizing the elastic deformation of the lock pieces 174, it is possible to remove the pump unit 16 in an order reverse to that at the time of the insertion thereof. Thus, it is possible to detachably mount the pump unit 16 to the tank main body 12. The left-hand side plate portion 25 and the right-hand side plate portion 26 of the sub tank 14 may be formed so as to be capable of elastic deformation.

Further, due to the bottom plate portion 24 of the sub tank 14, it is possible to guide the leg pieces 158 provided at the distal end (i.e., the front end portion) of the mount 30 of the pump unit 16 toward the rotation support means 164. Further, the guide pins 160 are formed so as to serve also as the pump unit side support portions of the rotation support means 164. Thus, there is no need to provide any special member as the pump unit side support portion.

A twelfth embodiment will be described based on FIGS. 30 through 33. Because the present embodiment corresponds to the eleventh embodiment having some changes, such changes will be mainly described. As shown in FIGS. 30 through 33, in the present embodiment, both right and left side end portions of the bottom plate portion 24 of the sub tank 14 of the eleventh embodiment further have step portions 180 making them one step higher and arranged symmetrically. Both step portions 180 extend linearly in the front-rear direction. On both step portions 180, there are arranged the guide rails 150, the lock pieces 162, and the regulation pieces 168.

Figure 30:
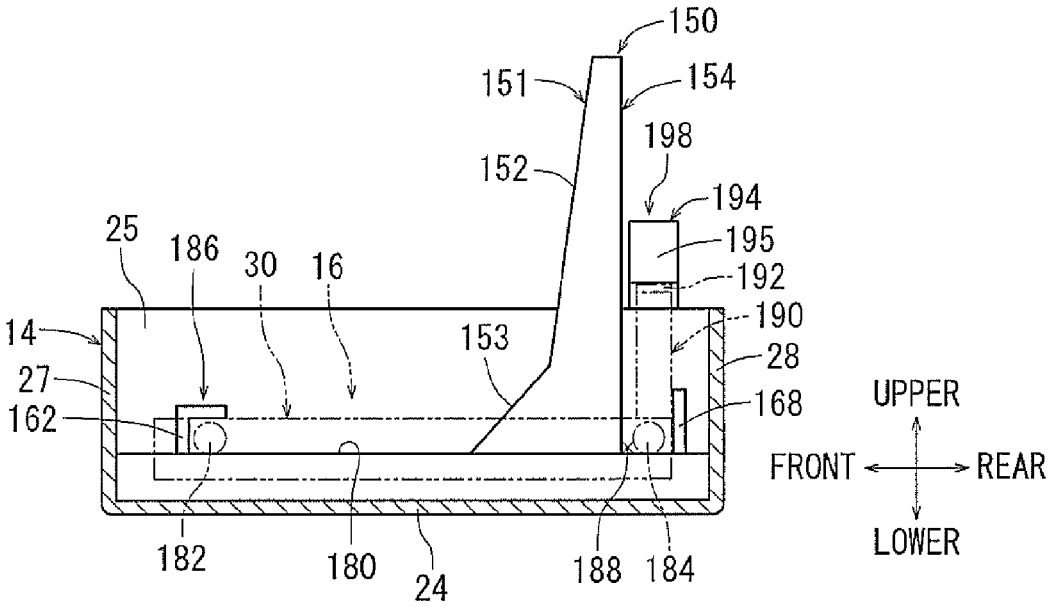
FIG. 30 is a sectional side view of the main portion of the fuel tank according to a twelfth embodiment.
Figure 31:
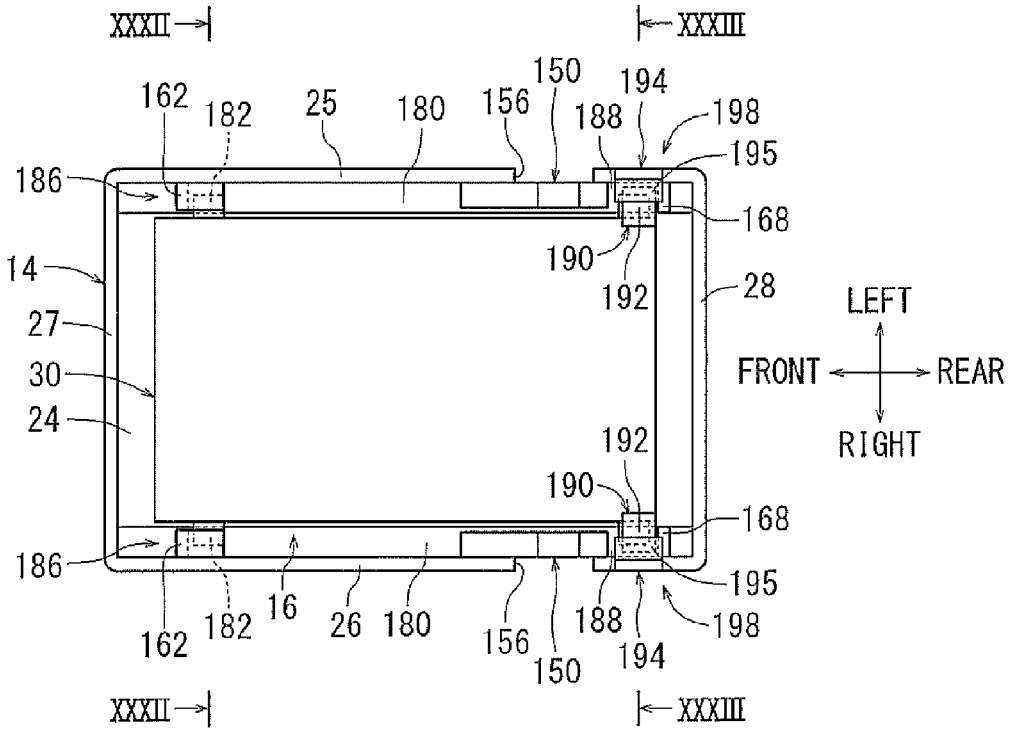
FIG. 31 is a plan view of the pump unit mounted to the sub tank.
Figure 32:
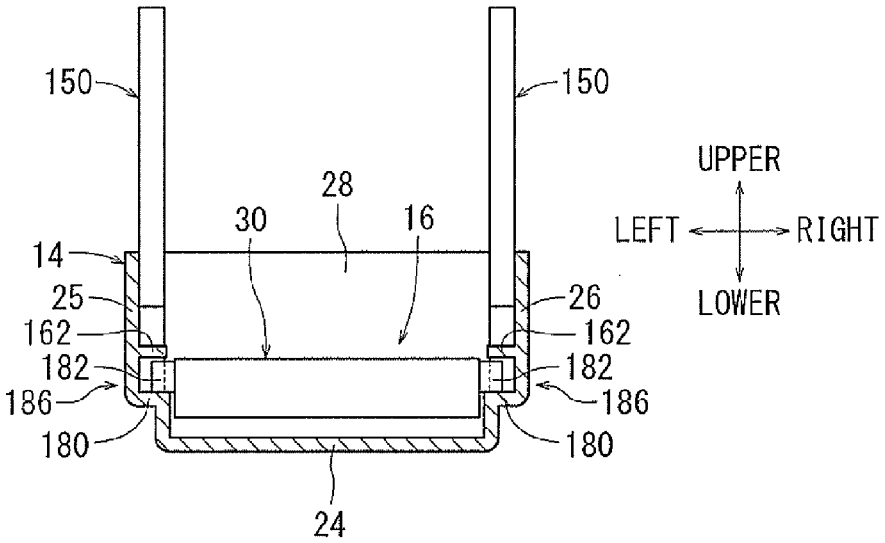
FIG. 32 is a cross-sectional view along line XXXII-XXXII in FIG. 31.

Further, in the present embodiment, the guide pins 160 and the guide pieces 166 of the eleventh embodiment are changed to front side guide pins 182 and rear side guide pins 184, respectively. The front side guide pins 182 are arranged at the front end portions of both right and left side surfaces of the mount 30. The front side guide pins 182 are formed, for example, as round shafts. The rear side guide pins 184 are arranged at the rear end portions of both right and left side surfaces of the mount 30. The rear side guide pins 184 are formed, for example, as round shafts. Further, the lock pieces 162 as the "tank main body side support portion" and the front side guide pins 182 as the "pump unit side support portion" form rotation support means 186 capable of mutual rotation and detachable engagement as shown in FIGS. 30 through 32. Further, on the step portions 180 of the bottom plate portion 24 of the sub tank 14, engagement grooves 188 are formed between both regulation pieces 168 and both guide rails 150 as shown in FIG. 30. The rear side guide pins 184 are configured to be engaged from above with the engagement grooves 188.

Figure 33:
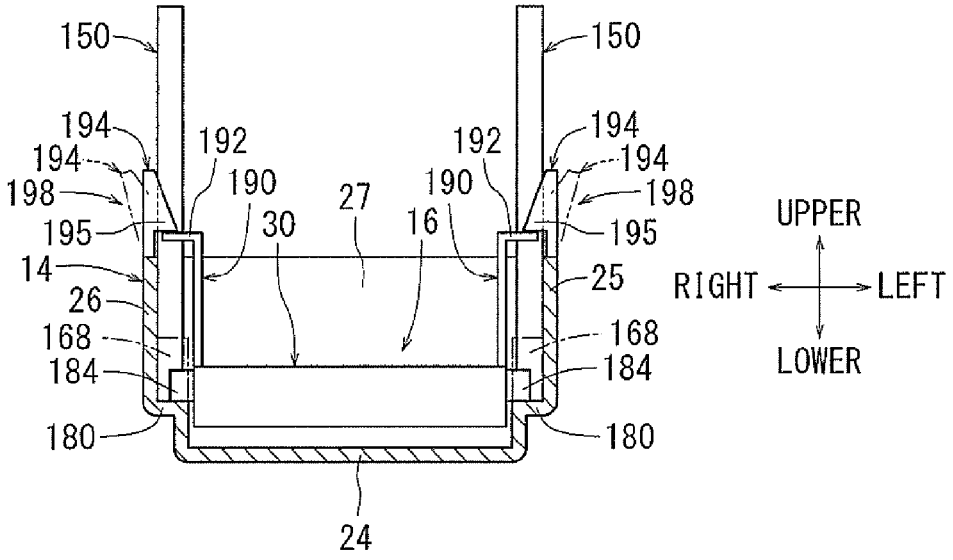
FIG. 33 is a cross-sectional view along line XXXIII-XXXIII in FIG. 32.

As shown in FIG. 33, on both right and left end portions of the rear end portion of the mount 30, there are symmetrically provided, for example, lock pillars 190. At the upper end portions of the lock pillars 190, flange portions 192 protruding outwardly sidewise are formed. Further, a pair of right and left lock pieces 194 are symmetrically provided on the rear end portions of the left-hand side plate portion 25 and the right-hand side plate portion 26 of the sub tank 14. On the upper portions of the lock pieces 194, lock claws 195 are formed to protrude inwardly sidewise. The lock pieces 194 are formed so as to be capable of elastic deformation or flexural deformation in the right-left direction as shown by the chain double-dashed line 194 in FIG. 33. The lock claws 195 are formed so as to be capable of being engaged with the flange portions 192 of the lock pillars 190 of the mount 30 by utilizing the elastic deformation of the lock pieces 194. The lock pillars 190 and the lock pieces 194 form lock means 198.

The step portions 180 of the sub tank 14 correspond to the "guide member" as referred to herein. The front side guide pins 182 correspond to the "slider," the "preceding side slider," and the "pump unit side support portion" as referred to herein. The rear side guide pins 184 correspond to the "slider," and the "succeeding side slider" as referred to herein. The lock pillars 190 correspond to the "pump unit side lock portion" as referred to herein. The lock pieces 194 correspond to the "tank main body side lock portion" as referred to herein.

Next, a method of mounting the pump unit 16 to the tank main body 12 will be described. The pump unit 16 is inserted into the tank main body 12 in a substantially vertical attitude in which one longitudinal end portion (i.e., the front end portion) thereof is inclined obliquely forwards. At this time, the front side guide pins 182 are engaged with the front side upstream guide portions 152 of the guide rails 150 of the sub tank 14, and are caused to slide downwards along the front side upstream guide portions 152. Subsequently, the front side guide pins 182 are caused to slide from the front side upstream guide portions 152 to the inclined guide portions 153. In this state, while forwardly moving the front side guide pins 182 along the step portions 180 of the bottom surface portion 21 of the tank main body 12, the rear side guide pins 184 are engaged with the rear side guide surfaces 154 of the guide rails 150, and are caused to slide downwards along the guide surfaces 154. Then, the front side guide pins 182 are engaged with the lock pieces 162 of the sub tank 14.

Subsequently, using the rotation support means 186 formed by the engagement between the lock pieces 162 and the front side guide pins 182 as the rotational fulcrum, the pump unit 16 is rotated downwards. That is, the rear end portion of the pump unit 16 is pressed down. And, when the flange portions 192 of the lock pillars 190 of the mount 30 contact the lock claws 195 of the lock pieces 194 of the sub tank 14, the lock pieces 194 are elastically deformed outwardly sidewise as shown by the chain double-dashed line 194 in FIG. 33. Then, when the flange portions 192 of the lock pillars 190 get over the lock claws 195, the lock pieces 194 are elastically restored, and the lock claws 195 are engaged or snap-fit-engaged with the flange portions 192 of the lock pillars 190 as shown in FIG. 33. With this, the rear side guide pins 184 are engaged with the engagement grooves 188 of the sub tank 14. As a result, the pump unit 16 is locked to the tank main body 12.

When the pump unit 16 is to be removed, the upper end portions of the lock pieces 194 are pushed outwardly sidewise in order to release the engagement of the lock claws 195 with the flange portions 192 of the lock pillars 190. Then, the pump unit 16 is rotated upwards using the rotation support means 186 as the rotation fulcrum. That is, the rear end portion of the pump unit 16 is raised. Then, the pump unit 16 is removed in an order reverse to that at the time of the insertion thereof.

In the fuel tank 10 described above, during the mounting process of the pump unit 16 into the tank main body 12, both guide pins 182 and 184 are guided by the guide rails 150 of the guide means. As a result, the pump unit 16 is guided from the tank hole 22 side of the tank main body 12 to the mounting position at the bottom portion side. Thus, it is possible to properly move the pump unit 16 to the mounting position easily without being at a loss. Thus, it is possible to shorten the operation time, and to suppress defective mounting of the pump unit 16. Thus, it is possible to achieve an improvement in terms of the mounting property and mounting operations of the pump unit 16 with respect to the tank main body 12.

Further, the rotation support means 186 rotatably supporting one longitudinal end portion of the pump unit 16 are formed by the lock pieces 162 (i.e., the tank main body side support portions) provided on the tank main body 12, and the front side guide pins 182 (i.e., the pump unit side support portions) provided on the pump unit 16 and configured to be engaged with the lock pieces 162. Further, the guide rails 150 are provided with the front side upstream guide portions 152 and the rear side guide surfaces 154. Thus, due to the front side upstream guide portions 152 and the rear side guide surfaces 154 of the guide rails 150, it is possible to guide the front side guide pins 182 and 184 of the pump unit 16 from the upper end portion side to the bottom portion side. Further, due to the engagement between the lock pieces 162 (i.e., the tank main body side support portions) of the rotation support means 186 and the front side guide pins 182 (i.e., the pump unit side support portions) it is possible to rotatably support one longitudinal end portion (i.e., the front end portion) of the pump unit 16. Thus, it is possible to easily rotate the pump unit 16 to the mounting position at the bottom portion side of the tank main body 12 using the rotation support means 186 as the rotational fulcrum.

Further, between the tank main body 12 and the pump unit 16, there is provided the lock means 198 effecting mutual engagement when the pump unit 16 is rotated to the mounting position at the bottom portion side of the tank main body 12 using the rotation support means 186 as the rotational fulcrum. The lock means 198 include the lock pieces 194 provided on the tank main body 12, and the lock pillars 190 provided on the pump unit 16 and configured to be engaged with the lock pieces 194. The lock pieces 194 and the lock pillars 190 are formed so as to be capable of engagement by utilizing the elastic deformation of the lock pieces 194. Thus, when the pump unit 16 is rotated to the mounting position at the bottom portion side of the tank main body 12, the lock pillars 190 are engaged with the lock pieces 194 by utilizing the elastic deformation of the lock pieces 194, whereby the pump unit 16 is locked to the tank main body 12. Further, by releasing the engagement of the lock pillars 190 with the lock pieces 194 by utilizing the elastic deformation of the lock pieces 194, it is possible to remove the pump unit 16 in an order reverse to that at the time of the insertion thereof. Thus, it is possible to detachably mount the pump unit 16 to the tank main body 12. The lock pillars 190 may be formed so as to be capable of elastic deformation.

Further, due to the step portions 180 of the bottom plate portion 24 of the sub tank 14, it is possible to guide the front side guide pins 182 disposed at the distal end portion (i.e., the front end portion) of the mount 30 of the pump unit 16 toward the rotation support means 186. Further, the front side guide pins 182 are formed so as to also serve as the pump unit side support portion of the rotation support means 186. Thus, there is no need to provide any special member as the pump unit side support portion.

Figure 34:
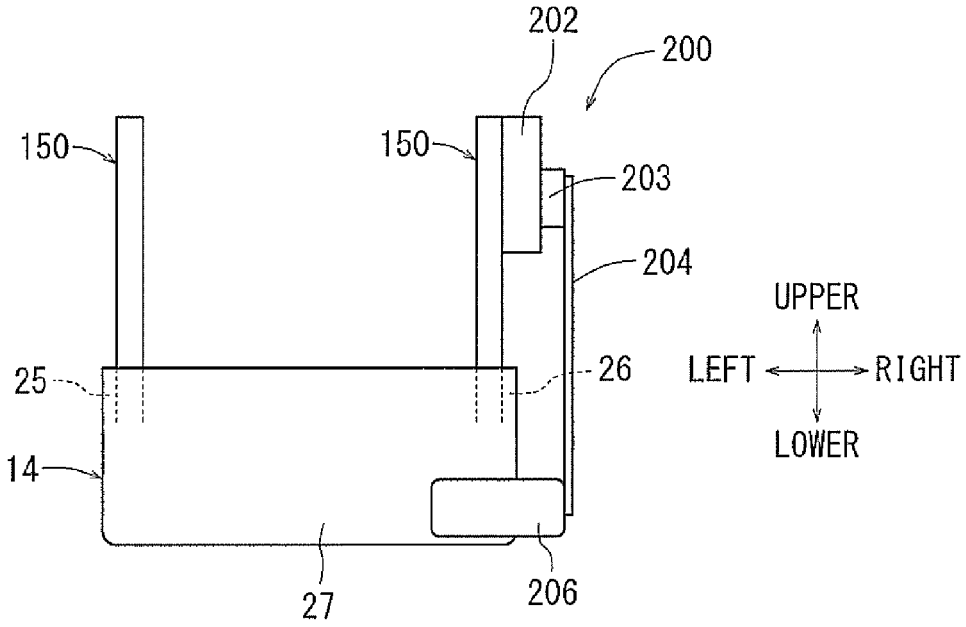
FIG. 34 is a front view of a main portion of the fuel tank according to a thirteenth embodiment.
Figure 35:
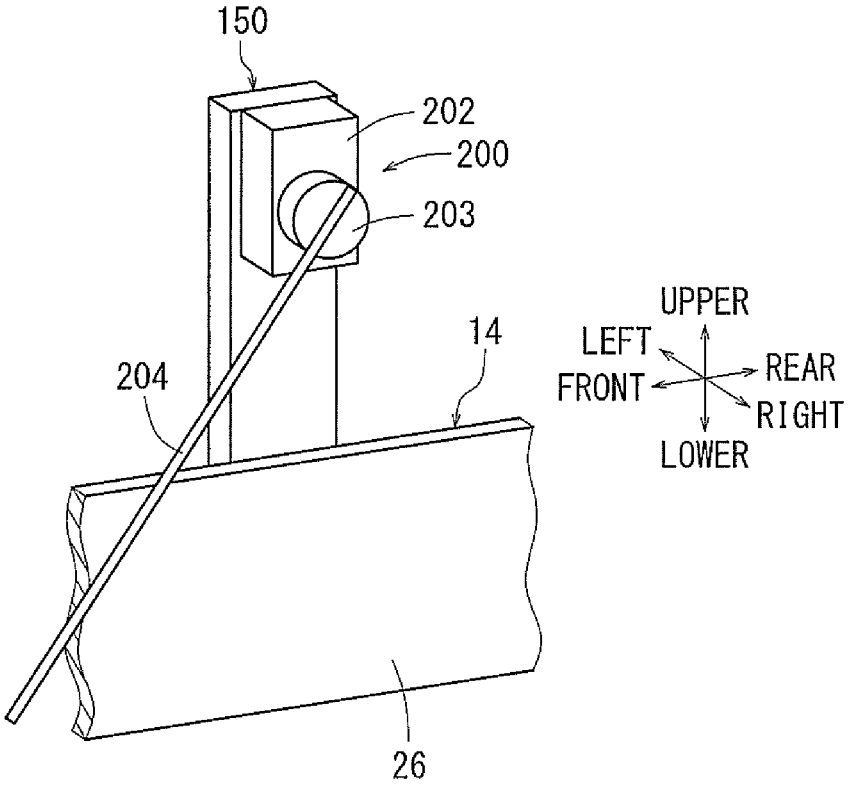
FIG. 35 is a perspective view of the main portion of the fuel tank.

A thirteenth embodiment will be described based on FIGS. 34 and 35. As shown in FIGS. 34 and 35, in the present embodiment, there is provided a sender gauge 200 on an upper end portion of an outer side surface of the right guide rail 150, for example, of the eleventh embodiment. The sender gauge 200 is a fuel residual amount detection device, and is composed of a gauge main body 202 attached to the upper end portion of the guide rail 150, an arm 204 supported by a rotating portion 203 of the gauge main body 202 in a cantilever-like fashion, and a float 206 mounted to the distal end of the arm 204. The gauge main body 202 outputs fuel residual amount signals depending on the position of the float 206 moving up and down in accordance with the fuel residual amount in the tank main body 12, that is, the rotational position of the rotating portion 203.

The position where the gauge main body 202 of the sender gauge 200 is attached is not restricted to the upper end portion of the guide rail 150. The gauge main body 202 may be attached to an arbitrary position of the guide rail 150 exposed from the sub tank 14. Further, instead of being attached to the guide rail 150, the gauge main body 202 of the sender gauge 200 may be attached to the guide rail 114 of the seventh embodiment. Further, instead of being attached to the guide rail 150, the gauge main body 202 of the sender gauge 200 may be attached to the guide rail 55 of the first embodiment, the guide rail 84 of the third embodiment, or the protrusion 25*a* of the left-hand side plate portion 25 or the protrusion 26*a* of the right-hand side plate portion 26 of the sub tank 14 on which the guide rail 104 is provided.

The above-described embodiments may be further modified. For example, the present disclosure is also applicable to a fuel tank equipped with a tank main body having an opening in a side surface portion thereof. Further, the number of components mounted in the pump unit may be increased. Apart from the sender gauge (i.e., the fuel residual amount detection device) examples of the components to be added include a jet pump transferring fuel outside the sub tank into the tank, and a pressure sensor detecting the pressure inside the tank main body. The sub tank may be omitted. The third guide portion and the second guide portion of the guide rail may be omitted. Further, of both guide means of the pump unit 16, one guide means may be omitted.

The various examples described above in detail with reference to the attached drawings are intended to be representative of the disclosure and thus not limiting. The detailed description is intended to teach a person of skill in the art to make, use and/or practice various aspects of the present teachings and thus is not intended to limit the scope of the disclosure. Furthermore, each of the additional features and teachings disclosed above may be applied and/or used separately or with other features and teachings to provide improved fuel vapor processing apparatuses, and/or methods of making and using the same. Moreover, the various combinations of features and steps disclosed in the above detailed description may not be necessary to practice the disclosure in the broadest sense, and are instead taught to describe representative examples of the disclosure. Further, various features of the above-described representative examples, as well as the various independent and dependent claims below, may be combined in ways that are not specifically and explicitly enumerated in order to provide additional useful embodiments of the present teachings. All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel tank comprising:

a tank main body having an opening;

a pump unit configured to be mounted to a mounting position on a bottom of the tank main body through the opening and having a fuel pump and a pump retaining member retaining the fuel pump; and a guide means configured to guide the pump unit from an opening side of the tank main body to the mounting position on a bottom side of the tank main body;

wherein the guide means includes a guide rail provided on the tank main body and a slider provided on the pump unit;

wherein the slider is configured to be slidably engaged with the guide rail; and wherein the guide rail is configured such that an orientation of the pump unit with respect to the tank main body varies as the slider slides along the guide rail, so that (a) the opening of the tank main body and (b) the pump unit is oriented in a second direction that is different from the first direction when the pump unit is positioned at the mounting position on the bottom of the tank main body.

2. The fuel tank according to claim 1, wherein a pair of the guide means are arranged on both sides of the pump unit.

3. The fuel tank according to claim 1, wherein the tank main body has a sub tank disposed on the bottom of the tank main body and configured to store fuel to be sucked into the fuel pump; and wherein the guide rail extends to a position above an upper limit of the sub tank for storing the fuel in a horizontal attitude.

4. The fuel tank according to claim 1, further comprising:

a rotation support means configured to rotatably support a longitudinal end portion of the pump unit inserted into the tank main body;

wherein the rotation support means includes a tank main body side support portion provided on the tank main body, and a pump unit side support portion provided on the pump unit;

wherein the pump unit side support portion is configured to be engaged with the tank main body side support portion; and wherein the guide rail has a first guide portion extending from the opening side toward the bottom side of the tank main body.

5. The fuel pump according to claim 4, wherein the guide rail has a second guide portion continuous with a bottom side end of the first guide portion and configured to guide the slider when the pump unit is rotated downwards using the rotation support means as a rotational fulcrum.

6. The fuel tank according to claim 5, wherein the second guide portion of the guide rail has a radius of curvature gradually diminished as the second guide portion extends downwards;

wherein the slider has an elastic member formed so as to be capable of elastic deformation when the slider slides downwards on the second guide portion; and wherein the second guide portion has a lock portion configured to be engaged with the slider through elastic restoration of the elastic member of the slider when the pump unit is rotated to the mounting position on the bottom of the tank main body.

7. The fuel tank according to claim 4, further comprising:

a lock means including a tank main body side lock portion provided on the tank main body, and a pump unit side lock portion provided on the pump unit;

wherein the tank main body side lock portion and the pump unit side lock portion are configured to be engaged with each other by utilizing elastic deformation of at least one of the tank main body side lock portion and the pump unit side lock portion when the pump unit is rotated to the mounting position on the bottom of the tank main body using the rotation support means as a rotational fulcrum.

8. The fuel tank according to claim 4, wherein the slider includes a preceding side slider disposed at the longitudinal end portion of the pump unit; and wherein the guide rail has a third guide portion continuous with a bottom side end of the first guide portion and configured to guide the preceding side slider to a predetermined position along the bottom of the tank main body.

9. The fuel tank according to claim 8, wherein the preceding side slider serves as the pump unit side support portion.

10. The fuel tank according to claim 4, wherein the guide means includes a guide member at the bottom side of the tank main body; and wherein the guide member is configured to guide the longitudinal end portion of the pump unit along the bottom of the tank main body.

11. The fuel tank according to claim 10, wherein the longitudinal end portion of the pump unit has a stopper member;

wherein the tank main body has a contact member configured to contact the longitudinal end portion of the pump unit and an engagement member configured to be engaged with the stopper member;

wherein the contact member and the engagement member serve as the tank main body side support portion; and wherein the stopper member serves as the pump unit side support portion.

12. The fuel tank according to claim 10, wherein the longitudinal end portion of the pump unit has a pump unit side lock portion;

wherein the tank main body has a tank main body side lock portion configured to be engaged with the pump unit side lock portion;

wherein the tank main body side lock portion serves as the tank main body side support portion; and wherein the pump unit side lock portion serves as the pump unit side support portion.

13. The fuel tank according to claim 1, wherein the first direction is substantially perpendicular to the bottom of the tank main body, and the second direction is substantially parallel to the bottom of the tank main body.

* * * * *